US007418953B2

(12) United States Patent
Annoura

(10) Patent No.: US 7,418,953 B2
(45) Date of Patent: Sep. 2, 2008

(54) FUEL VAPOR TREATMENT APPARATUS FOR INTERNAL COMBUSTION ENGINE

(75) Inventor: Toshiki Annoura, Nagoya (JP)

(73) Assignee: Denso Corporation (JP)

( * ) Notice: Subject to any disclaimer, the term of this patent is extended or adjusted under 35 U.S.C. 154(b) by 54 days.

(21) Appl. No.: 11/705,066

(22) Filed: Feb. 12, 2007

(65) Prior Publication Data

US 2007/0186915 A1 Aug. 16, 2007

(30) Foreign Application Priority Data

Feb. 14, 2006 (JP) ..... 2006-037208
Feb. 15, 2006 (JP) ..... 2006-038494

(51) Int. Cl.
*F02M 33/04* (2006.01)
*F02M 33/02* (2006.01)

(52) U.S. Cl. ..... 123/520; 123/519

(58) Field of Classification Search ..... 123/520, 123/519, 518, 516, 521, 494, 198 D; 73/119 A, 73/23.2

See application file for complete search history.

(56) References Cited

U.S. PATENT DOCUMENTS 6,971,375 B2 12/2005 Amano et al.
2006/0042605 A1 3/2006 Amano et al.
2006/0225714 A1* 10/2006 Kano et al. ..... 123/520
2007/0157908 A1* 7/2007 Kano et al. ..... 123/520

FOREIGN PATENT DOCUMENTS

JP 7-269419 10/1995

* cited by examiner

*Primary Examiner*—Mahmoud Gimie
(74) *Attorney, Agent, or Firm*—Nixon & Vanderhye PC

(57) ABSTRACT

A fuel vapor treatment apparatus includes a first determiner that determines a concentration of purged fuel based on an amount of deviation from a target air-fuel ratio of an air-fuel ratio detected by a sensor provided in an exhaust pipe. A second determiner that determines the concentration of purged fuel in a state in which a purge control valve is closed. Air-fuel ratio controller controls a fuel injection quantity to bring an air-fuel ratio to the target air-fuel ratio on the basis of the concentration of the purged fuel. The air-fuel ratio controller uses the concentration of fuel determined by the second determiner when purge is started or restarted, and uses the concentration of fuel determined by the first determiner thereafter in the course of performing purge. It is possible to increase a purge ratio when purge is started or restarted.

19 Claims, 15 Drawing Sheets

| Ne \ TA | 38 | 49 | 59 | 69 | 79 | 86 | 100% |
|---|---|---|---|---|---|---|---|
| 800 | 20.1 | 14.5 | 11.2 | 8.6 | 6.2 | 4.6 | 0.0 |
| 1200 | 12.5 | 9.3 | 7.2 | 5.5 | 4.0 | 2.9 | 0.0 |
| 1600 | 9.3 | 6.8 | 5.3 | 4.0 | 2.9 | 2.1 | 0.0 |
| 2000 | 7.9 | 5.7 | 4.4 | 3.3 | 2.4 | 1.8 | 0.0 |
| 2400 | 6.0 | 4.5 | 3.5 | 2.6 | 1.9 | 1.4 | 0.0 |
| 2800 | 5.5 | 4.1 | 3.1 | 2.3 | 1.7 | 1.2 | 0.0 |
| 3200 | 4.9 | 3.6 | 2.7 | 2.0 | 1.5 | 1.1 | 0.0 |
| 3600 | 4.1 | 3.0 | 2.2 | 1.7 | 1.3 | 0.9 | 0.0 |
| 4000 | 3.4 | 2.4 | 1.8 | 1.4 | 1.1 | 0.8 | 0.0 |

FUEL VAPOR TREATMENT APPARATUS FOR INTERNAL COMBUSTION ENGINE

CROSS-REFERENCE TO RELATED APPLICATION

This application is based on Japanese Patent Applications No. 2006-37208 filed on Feb. 14, 2006, and No. 2006-38494 filed on Feb. 15, 2006, the disclosures of which are incorporated herein by reference.

FIELD OF THE INVENTION

The present invention relates to a fuel vapor treatment apparatus of an internal combustion engine.

BACKGROUND OF THE INVENTION

A fuel vapor treatment apparatus prevents fuel vapor developed in a fuel tank from being dissipated to the atmosphere and introduces the fuel vapor into a canister. The canister accommodates an absorbing material to adsorb the fuel vapor temporarily. When an internal combustion engine is operated, the adsorbed fuel vapor is desorbed from the absorbing material by negative pressure developed in an intake pipe and is purged into the intake pipe of the internal combustion engine via a purge pipe. In this manner, when the fuel vapor is desorbed from the adsorbing material, the adsorbing capacity of the adsorbing material is recovered.

When the fuel vapor is being purged, the air-fuel ratio of an air-fuel mixture introduced into the internal combustion engine needs to be controlled to a state close to a target air-fuel ratio (generally, stoichiometric air-fuel ratio). JP-A 7-269419 shows a fuel vapor treatment system in which an air-fuel ratio sensor for actually measuring an air-fuel ratio is provided in the exhaust pipe of the internal combustion engine. A feedback control is performed on the basis of the deviation from the target air-fuel ratio of an air-fuel ratio measured by the air-fuel sensor to control a fuel injection quantity to bring the air-fuel ratio of the air-fuel mixture introduced into the internal combustion engine to the target air-fuel ratio.

In this system, the state of concentration of the fuel vapor of an air-fuel mixture containing fuel vapor purged from a canister is determined on the basis of such a deviation from the target air-fuel ratio of an air-fuel ratio as is measured by the air-fuel sensor. Here, the concentration of fuel vapor is a kind of state of the fuel. A fuel injection quantity is controlled on the basis of the concentration of fuel vapor (that is, state of fuel) to bring the air-fuel ratio to the target air-fuel ratio.

In a case that an air-fuel ratio is actually measured by the air-fuel sensor and the deviation from the target air-fuel ratio of the measured air-fuel ratio is fed back to determine a fuel injection quantity, if the fuel vapor is not purged, the fuel injection quantity cannot be determined.

Hence, it is necessary to bring a purge ratio to a small value not to cause large air-fuel variations when the purging of the fuel vapor is started and then to increase the purge ratio gradually. Moreover, also when the purging of the fuel vapor is interrupted and then is started again, similarly, it is necessary to set an initial purge ratio smaller and then to increase the purging ratio gradually. For this reason, there is presented a problem that the amount of purge cannot be sufficiently increased.

SUMMARY OF THE INVENTION

The present invention has been made on the basis of these circumstances. The object of the present invention is to provide a fuel vapor treatment apparatus of an internal combustion engine capable of increasing the amount of purge of fuel vapor sufficiently.

A fuel vapor treatment apparatus of the present invention includes a canister, a purge pipe, a purge control valve, an air-fuel ratio sensor provided in an exhaust pipe. The apparatus includes a first fuel state determination means that determines a state of fuel of an air-fuel mixture on the basis of an amount of deviation from a target air-fuel ratio when the purge control valve is opened. The apparatus further includes an air-fuel ratio control means that controls a fuel injection quantity to bring an air-fuel ratio to the target air-fuel ratio on the basis of the state of fuel of the air-fuel mixture purged from the canister. The apparatus further includes second fuel state determination means that determines the state of fuel of the air-fuel mixture purged from the canister in a state in which the purge control valve is closed. The air-fuel ratio control means switches a state of fuel used for controlling the fuel injection quantity between the state of fuel determined by the first fuel state determination means and the state of fuel determined by the second fuel state determination means on the basis of an operating state of a vehicle.

The first fuel state determination means determines the state of fuel on the basis of an air-fuel ratio detected by the air-fuel sensor when the purge control valve is opened, so the first fuel state determination means does not determine the state of fuel if purge is not actually performed. On the other hand, the second fuel state determination means determines the state of fuel in a state in which the purge control valve is closed. Thus, a period of time during which the state of fuel cannot be determined is decreased. Then, the air-fuel ratio control means switches the state of fuel used for determining the fuel injection quantity between the state of fuel determined by the first fuel state determination means and the state of fuel determined by the second fuel state determination means on the basis of the operating state of the vehicle. A period of time during which the fuel injection quantity cannot be determined on the basis of the state of fuel is decreased. Thus, a state is decreased in which a purge ratio needs to be reduced to a small value not to affect an air-fuel ratio. Hence, the amount of purge can be increased.

Moreover, according to the fuel vapor treatment apparatus of the present invention, when an abnormality is not detected by the abnormality detection means, the air-fuel ratio control means switches a state of fuel used for controlling the fuel injection quantity. The state is switched between the state of fuel determined by the first fuel state determination means and the state of fuel determined by the second fuel state determination means on the basis of an operating state of a vehicle. When an abnormality is detected by the abnormality detection means, the air-fuel ratio control means uses the state of fuel determined by the first fuel state determination means as the state of fuel used for controlling the fuel injection quantity irrespective of the operating state of the vehicle.

The first fuel state determination means determines the state of fuel on the basis of an air-fuel ratio detected by the air-fuel ratio sensor when the purge control valve is opened, so the first fuel state determination means cannot determine the state of fuel if purge is not actually performed. On the other hand, the second fuel state determination means determines the state of fuel in a state in which the purge control valve is closed. Thus, when the fuel vapor treatment apparatus is provided with the first and second fuel state determination means, a period of time during which the state of fuel cannot be determined is decreased.

Moreover, the air-fuel ratio control means switches the state of fuel used for a fuel injection quantity between the state of fuel determined by the first fuel state determination means and the state of fuel determined by the second fuel state determination means on the basis of the operating state of a vehicle. A period of time during which the fuel injection quantity cannot be determined on the basis of the state of fuel is decreased. Thus, a state is decreased in which a purge ratio needs to be reduced to as small a value as does not affect an air-fuel ratio and hence the amount of purge can be increased. In addition, when an abnormality in the second fuel state determination means is detected by the abnormality detection means, the state of fuel determined by the first fuel state determination means is used irrespective of the operating state of the vehicle. Hence, it is also possible to prevent the fuel injection quantity from being controlled on the basis of the abnormal state of fuel.

DETAILED DESCRIPTION OF THE PREFERRED EMBODIMENTS

First Embodiment

Figure 1:
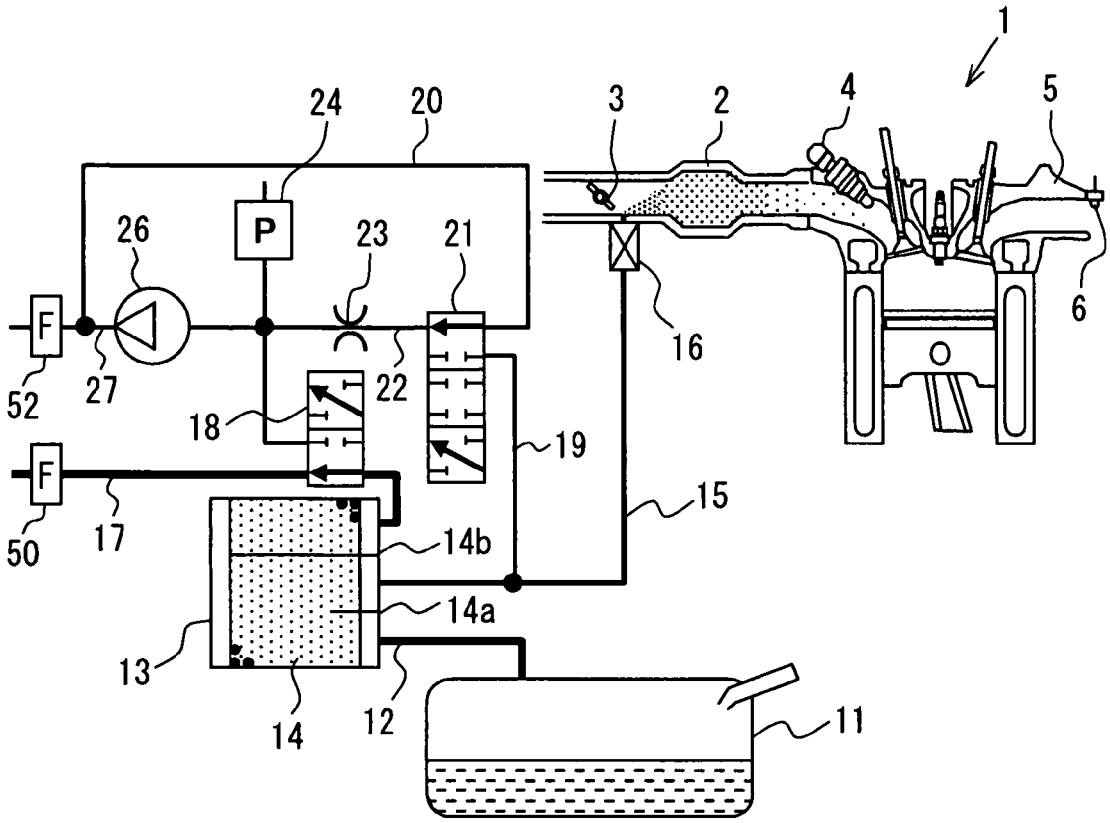
FIG. 1 is a construction diagram to show the construction of a fuel vapor treatment apparatus according to an embodiment of the present invention.

A preferred embodiment of the present invention will be described below. FIG. 1 is a construction diagram to show the construction of a fuel vapor treatment apparatus according to an embodiment of the present invention. A fuel vapor treatment apparatus according to this embodiment can be applied to, for example, an engine of an automobile, and a fuel tank 11 of an engine 1 of an internal combustion engine is connected to a canister 13 via an evaporation line 12 of a vapor introduction passage.

The canister 13 accommodates an absorbing material 14 and temporarily absorbs the fuel vapor developed in the fuel tank 11 by the absorbing material 14. The canister 13 is connected to an intake pipe 2 of the engine 1 via a purge line 15 of a purge pipe. The purge line 15 is provided with a purge valve 16 of a purge control valve, and when the purge valve 16 is opened, the canister 13 communicates with the intake pipe 2.

A partition plate 14*a* is provided between a position where the evaporation line 12 is connected to the canister 13 and a position where the purge line 15 is connected to the canister 13 and prevents the fuel vapor introduced from the evaporation line 12 from being purged from the purge line 15 without being absorbed by the absorbing material 14. Moreover, the canister 13 has an atmosphere line 17 also connected thereto, as will be described later. A partition plate 14*b* which is nearly equal to the packing depth of the absorbing material 14 is provided between a position where the atmosphere line 17 is connected to the canister 13 and a position where the purge line 15 is connected to the canister 13 in the canister 13. With this, the partition plate 14*b* prevents the fuel vapor introduced from the evaporation line 12 from being purged from the atmosphere line 17.

The purge valve 16 is a solenoid valve and has its opening adjusted by an electronic control unit (not shown) for controlling the respective parts of the engine 1. The flow rate of an air-fuel mixture flowing through the purge line 15 and containing the fuel vapor is controlled by the opening of the purge valve 16. The air-fuel mixture is purged into the intake pipe 2 by negative pressure developed in the intake pipe 2 by a throttle valve 3 and is combusted with fuel injected from an injector 4 (hereinafter, the air-fuel mixture containing the purged fuel vapor is referred to as purge gas).

The atmosphere line 17 having its end opened to the atmosphere via a filter 50 is connected to the canister 13. The atmosphere line 17 is provided with a switching valve 18 that makes the canister 13 communicate with the atmosphere line 17 or the suction side of a pump 26. Here, when the switching valve 18 is not driven by the electronic control unit, the switching valve 18 is at a first position where the canister 13 is made to communicate with the atmosphere line 17. When the switching valve 18 is driven by the electronic control unit, the switching valve 18 is switched to a second position where the canister 13 is made to communicate with the suction side of the pump 26.

A branch line 19 branched from the purge line 15 is connected to one input port of a three-way position valve 21. An air supply line 20 branched from a discharge line 27 of the pump 26, opened to the atmosphere via a filter 52, is connected to the other input port of the three-way valve 21. A measurement line 22 of a measurement passage is connected to the output port of the three-way valve 21. The three-way valve 21 is measurement passage switching means and is switched by the above-mentioned electronic control unit to any one of a first position, a second position, and a third position. In the first position, the air supply line 20 is connected to the measurement line 22. In the second position, the communication of the measurement line 22 with both of the air supply line 20 and the branch line 19 is interrupted. In the third position, the branch line 19 is connected to the measurement line 22. Here, when the three-way position valve 21 is not operated, the three-way position valve 21 is constructed to be set at the first position.

The measurement line 22 is provided with an orifice 23 and the pump 26. The pump 26 of gas flow generating means is an electrically operated pump. When the pump 26 is operated, the pump 26 flows gas through the measurement line 22 with an orifice 23 side as a suction side. The starting or stopping operating the pump 26 and the number of revolutions of the pump 26 are controlled by the electronic control unit. When the electronic control unit operates the pump 26, the electronic control unit controls the number of revolutions the pump 26 to a previously set specified value.

When the electronic control unit operates the pump 26 in a state in which the three-way position valve 21 is brought to the first position with the switching valve 18 held set at the first position, there is brought about "a first state of measurement" in which air flows through the measurement line 22. Moreover, when the electronic control unit operates the pump 26 in a state in which the three-way position valve 21 is brought to the third position, there is brought about "a second state of measurement" in which an air-fuel mixture flows through the measurement line 22. The air-fuel mixture containing the fuel vapor is supplied via the atmosphere line 17, the canister 13, a portion of the purge line 15 to the branch line 19, and the branch line 19

Moreover, one end of a pressure sensor 24 of pressure measurement means is connected to the downstream side of the orifice 23, that is, a portion between the orifice 23 and the pump 26. The other end of the pressure sensor 24 is opened to the atmosphere. A differential pressure between the atmospheric pressure and a pressure downstream of the orifice 23 is detected by the pressure sensor 24. The pressure measured by the pressure sensor 24 is outputted to the electronic control unit.

The electronic control unit controls the opening of the throttle valve 3 provided in the intake pipe 2 and for adjusting an intake air volume, a fuel injection quantity from the injector 4, the opening of the purge valve 16, and the like on the basis of the detection values detected by various kinds of sensors. For example, the electronic control unit controls the opening of the throttle valve 3, the fuel injection quantity, the opening of the purge valve 16, and the like on the basis of not only an intake air volume detected by an air flow sensor (not shown) provided in the intake pipe 2 and an intake air pressure detected by an intake air pressure sensor (not shown), an air-fuel ratio detected by an air-fuel ratio sensor 6 provided in an exhaust pipe 5, but also an ignition signal, an engine speed, an engine coolant temperature, an accelerator position, and the like.

Figure 2:
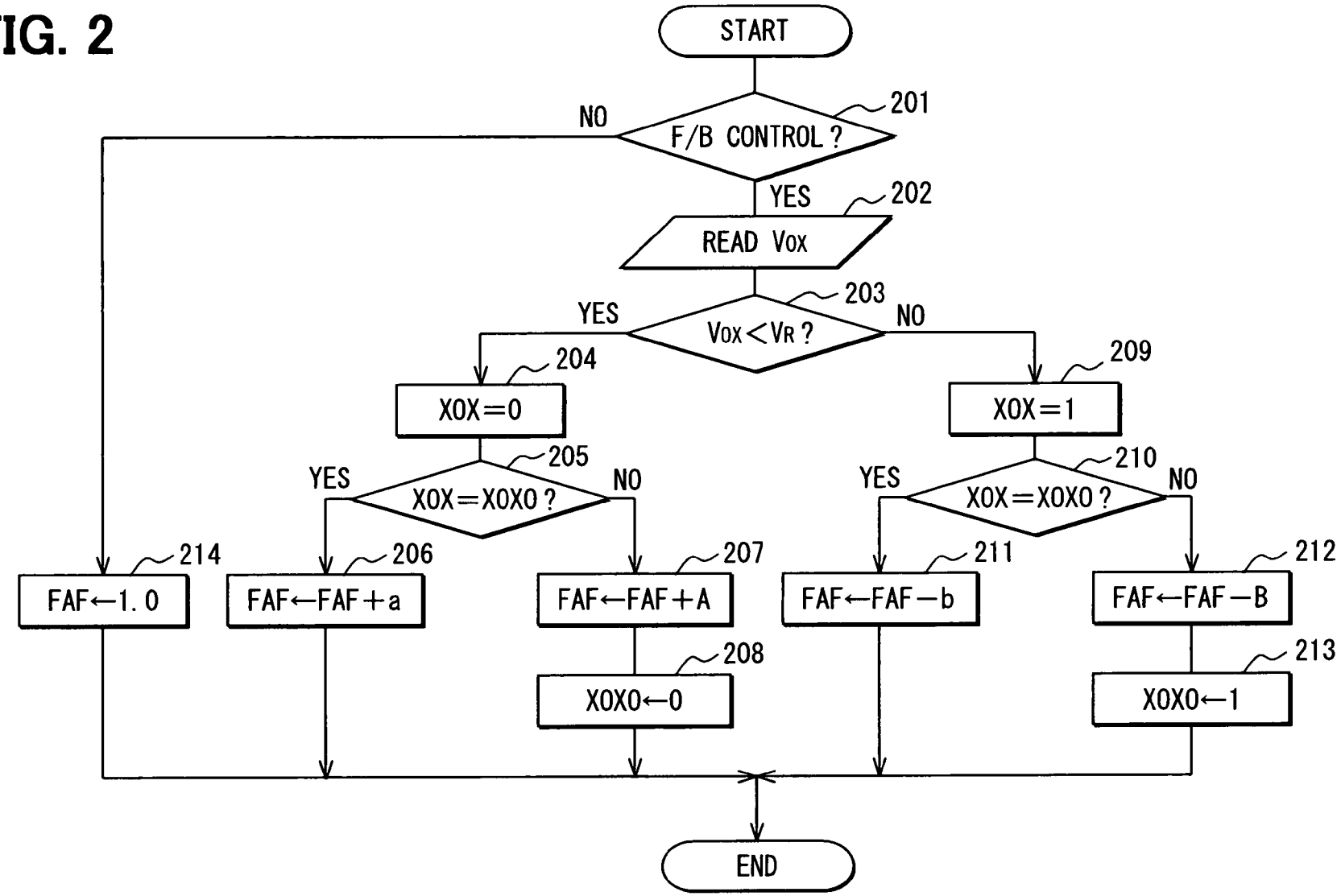
FIG. 2 is a flowchart of an air-fuel ratio control routine.

Next, the control of the electronic control unit according to the present invention will be described in detail. FIG. 2 is a flowchart of an air-fuel ratio control routine that is executed at intervals of a specified cam angle.

In step 201, it is determined whether an air-fuel ratio feedback control is allowed. That is, when all of the following conditions that:

(1) an operation is not at the startup;
(2) a fuel cut is not in the course of being performed;
(3) a coolant temperature (THW)≧0 C.°; and
(4) an air-fuel ratio sensor is completely activated, are satisfied, an air-fuel ratio feedback control is allowed. If any one of the above-mentioned conditions is not satisfied, the air-fuel ratio feedback control is not allowed.

When determination in step 201 is affirmative, the routine proceeds to step 202. In step 202, an output voltage Vox of the air-fuel ratio sensor 6 is read and in step 203, it is determined whether the output voltage $V_{OX}$ is a specified reference voltage $V_R$ (for example, 0.45 V) or less. When determination in step 203 is affirmative, it is assumed that the air-fuel ratio of exhaust gas is lean and the routine proceeds to step 204 in which an air-fuel ratio flag XOX is set at "0".

Next, in step 205, it is determined whether the air-fuel ratio flag XOX is identical to a state holding flag XOXO. When determination in step 205 is affirmative, it is assumed that a lean state continues and, in step 206, an air-fuel ratio correction factor FAF is increased by a lean integrated amount "a" and this routine is finished. On the other hand, when determination in step 205 is negative, it is assumed that a rich state is reversed to a lean state and the routine proceeds to step 207 in which the air-fuel ratio correction factor FAF is increased by a lean skip amount "A". Here, the lean skip amount "A" is set at a sufficiently large value as compared with the lean integrated amount "a". Then, the routine proceeds to step 208 in which the state holding flag XOXO is reset and then this routine is finished.

When determination in step 203 is negative, it is assumed that the air-fuel ratio of exhaust gas is rich and the routine proceeds to step 209 in which the air-fuel ratio flag XOX is set at "1". Then, in step 210, it is determined whether the air-fuel ratio flag XOX is identical to a state holding flag XOXO. When determination in step 210 is affirmative, it is assumed that a rich state continues and, in step 211, the air-fuel ratio correction factor FAF is decreased by a rich integrated amount "b" and this routine is finished. On the other hand, when determination in step 210 is negative, it is assumed that a lean state is reversed to a rich state and the routine proceeds to step 212 in which the air-fuel ratio correction factor FAF is decreased by a rich skip amount "B". Here, the rich skip amount "B" is set at a sufficiently large value as compared with the rich integrated amount "b".

Next, in step 213, the state holding flag XOXO is set at "b" and then this routine is finished. Here, when determination in step 201 is affirmative, the routine proceeds to step 214 in which the air-fuel ratio correction factor FAF is set at "1.0" and then this routine is finished.

Figure 3:
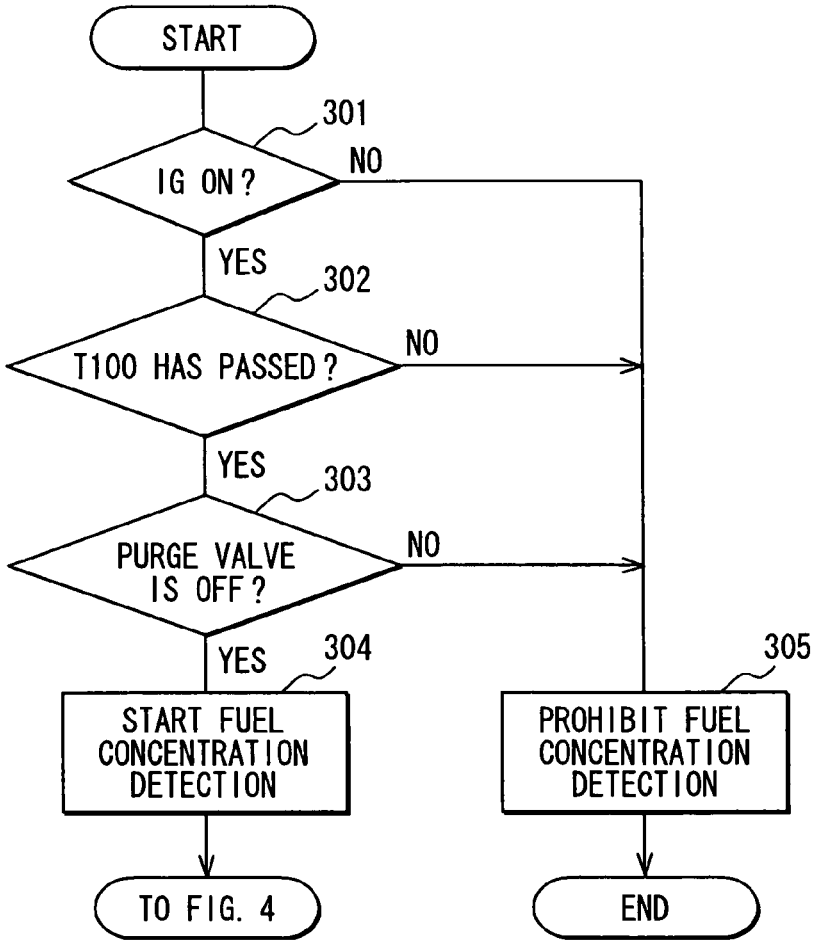
FIG. 3 is a flowchart to show a fuel concentration determination routine for determining a fuel vapor concentration in purge gas purged from a canister.

FIG. 3 is a flowchart to show a fuel concentration determination routine for determining a fuel vapor concentration in purge gas purged from the canister 13. This routine is executed in parallel to the routine in FIG. 2.

In step 301, it is determined whether an ignition switch is ON. When this determination is negative, the engine 1 is not started and purge control is not performed either, so it is determined in step 305 that the detection of concentration based on pressure measurement is prohibited and this routine is finished.

Figure 4:
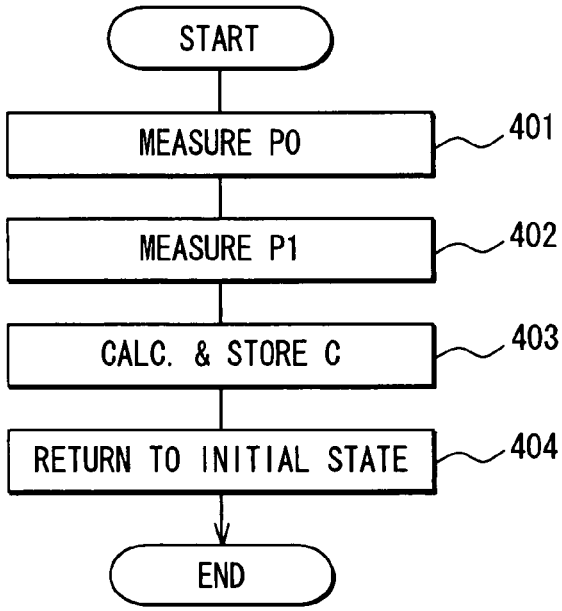
FIG. 4 is a flowchart to show a concentration detection routine for detecting a fuel concentration on the basis of pressure measurement.

On the other hand, when determination in step 301 is affirmative, in step 302, it is further determined whether a specified period T100 has passed after the last detection of fuel concentration, that is, the detection of fuel concentration based on FIG. 4. When determination in step 302 is negative, the above-mentioned step 305 is executed.

When determination in step 302 is affirmative, it is further determined in step 303 whether the purge valve 16 is OFF, that is, totally closed. When determination in step 303 is negative, that is, when the purge valve 16 is opened, the above-mentioned step 305 is executed.

When determination in step 303 is affirmative, it is determined in step 304 that the detection of fuel concentration based on pressure measurement is started, and the routine proceeds to FIG. 4.

FIG. 4 is a flowchart to show a fuel concentration detection routine for determining a fuel concentration based on pressure measurement, and this processing is a second means for determining a fuel concentration. Here, before executing this fuel concentration determination routine, the purge valve 16 is closed and the switching valve 18 is set at the first position in which the canister 13 communicates with the atmosphere line 17. The three-position valve 21 is set at the first position in which the air supply line 20 is connected to the measurement line 22. For this reason, in the initial state, a pressure detected by the pressure sensor 24 is nearly equal to the atmospheric pressure.

In step 401, pressure P0 is measured by the pressure sensor 24 in a state in which air flows through the measurement line 22. This state corresponds to "a first state of measurement". The measurement of the pressure P0 by an air flow is performed by operating the pump 26 with the three-position valve 21 held set at the first position. In this case, air is supplied to the measurement line 22 via the air supply line 20. A pressure upstream of the orifice 23 is the same as pressure at one end of the pressure sensor 24. The other end of the pressure sensor 24 is connected to the downstream side of the orifice 23 of the air supply line 20, so a pressure drop when air passes through the orifice 23 is detected by the pressure sensor 24.

Next, in step 402, pressure P1 is measured in a state in which the air-fuel mixture containing the fuel vapor is flowed through the measurement line 22. This state corresponds to "a second state of measurement". The measurement of the pressure P1 by using the air-fuel mixture flow is performed by operating the pump 26 with the three-position valve 21 being switched to the third position. In this case, the air-fuel mixture containing the fuel vapor supplied via the atmosphere line 17, the canister 13, a portion of the purge line 15 to the branch line 19, and the branch line 19 is supplied to the measurement line 22. That is, air introduced from the atmosphere line 17 is flowed through the canister 13 and is mixed with the fuel vapor, thereby being brought to the air-fuel mixture of the fuel vapor and air, and then the air-fuel mixture is supplied to the measurement line 22 via the portion of the purge line 15 and the branch line 19. Thus, when pressure by the air-fuel mixture is measured, a pressure drop when the air-fuel mixture containing the fuel vapor is passed through the orifice 23 of the measurement line 22 is detected by the pressure sensor 24.

In step 403, a fuel concentration C is computed on the basis of pressures P0 and P1 which are measured in step 401 and step 402 and is stored.

In the computation of the fuel concentration C, a pressure ratio RP between the pressure P0 and the pressure P1 is computed by a following equation (1) and the fuel concentration C is computed by a following equation (2) on the basis of the pressure ratio RP. In the equation (2), k1 is a constant determined suitably in advance by an experiment or the like.

$$RP=P1/P0 \tag{1}$$

$$C=k1\times(RP-1)(=(P1-P0)/P0) \tag{2}$$

The fuel vapor is heavier than air, so when purge gas contains the fuel vapor, its density becomes higher. If the number of revolutions of the pump 26 is the same and the velocity of flow (flow rate) in the measurement line 2 is the same, according to the law of energy conservation, as density becomes higher, a differential pressure across the orifice 23 becomes larger. Hence, as the fuel concentration C becomes larger, the pressure ratio RP becomes larger, and the relationship between the fuel concentration C and the pressure ratio RP becomes a linear relationship as shown by equation (2). Here, the fuel concentration C computed in this manner expresses the concentration of the fuel vapor in the purge gas by a mass ratio.

In the next step 404, the respective parts are returned to the initial states. That is, the switching valve 18 is returned to the first position in which the canister 13 communicates with the atmosphere line 17 and the three-position valve 21 is returned to the first position where the air supply line 20 is connected to the measurement line 22.

Figure 5:
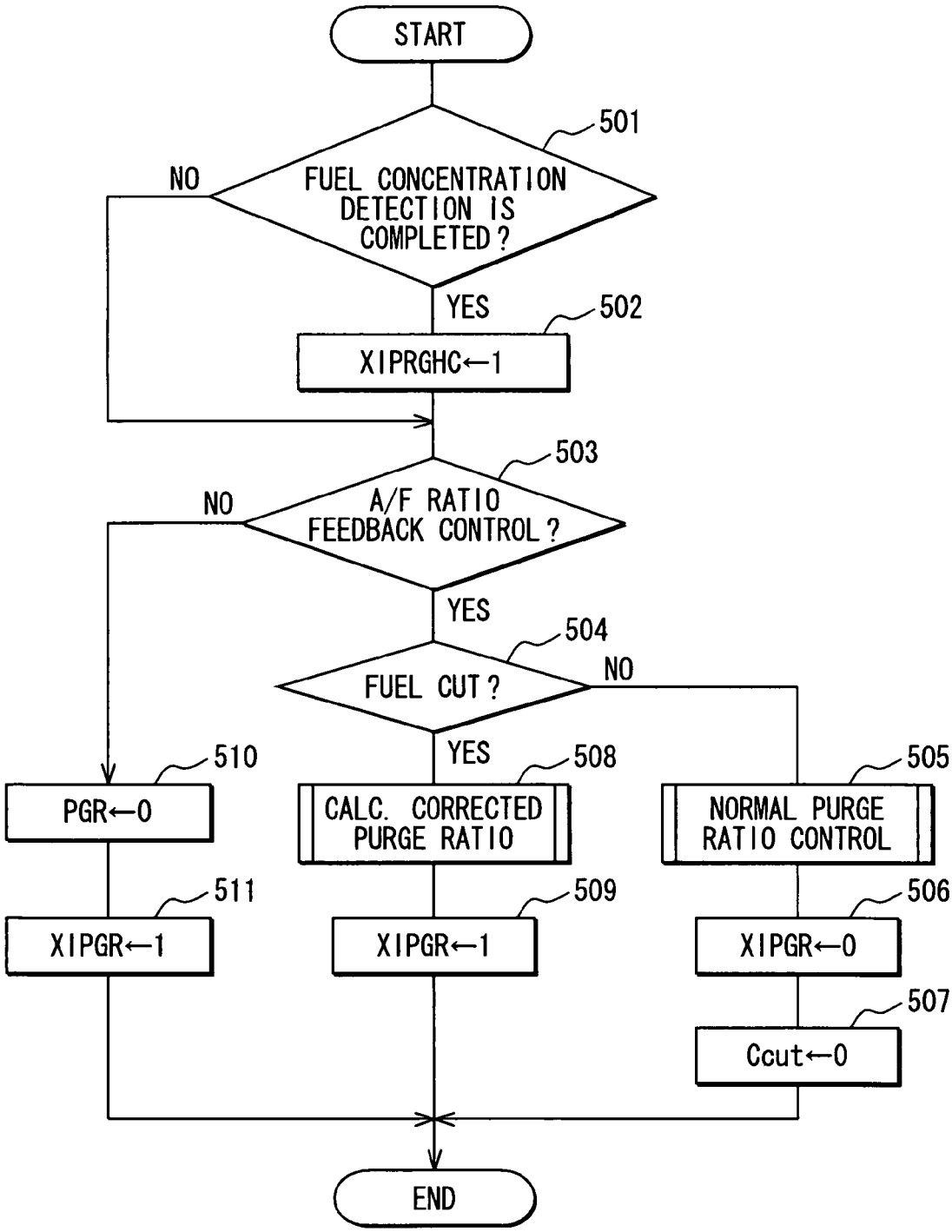
FIG. 5 is a flowchart of a purge ratio control routine.

FIG. 5 is a flowchart of a purge ratio control routine. In step 501, it is determined whether the detection of fuel concentration based on the pressure measurement shown in FIG. 4 is completed. When determination in step 501 is affirmative, a fuel concentration detection completion flag XIPRGHC is set at 1 in step 502, and then step 503 is executed. On the other hand, when determination in step 501 is negative, the processing of step 503 is directly executed.

In step 503, it is determined whether air-fuel ratio feedback control is being performed. When determination in step 503 is affirmative, the routine proceeds to step 504 in which it is determined whether fuel cut is in the course of being performed.

When determination in step 504 is negative, the routine proceeds to step 505 in which normal purge ratio control is performed, and then the routine proceeds to step 506. In step 506, a purge stop flag XIPGR is reset (set at 0) and a fuel cut counter Ccut is reset in step 507 and this routine is finished.

When determination in step 504 is affirmative, the routine proceeds to step 508 in which a purge ratio to be corrected at the time of restarting purge is computed, and then the purge stop flag XIPRG is set at 1 in step 509, and this routine is finished.

Moreover, when determination in step 503 is negative, the routine proceeds to step 510 in which a purge ratio PGR is reset (set at 0), and then in step 511, the purge stop flag XIPGR is set at "1" and this routine is finished.

Figure 6:
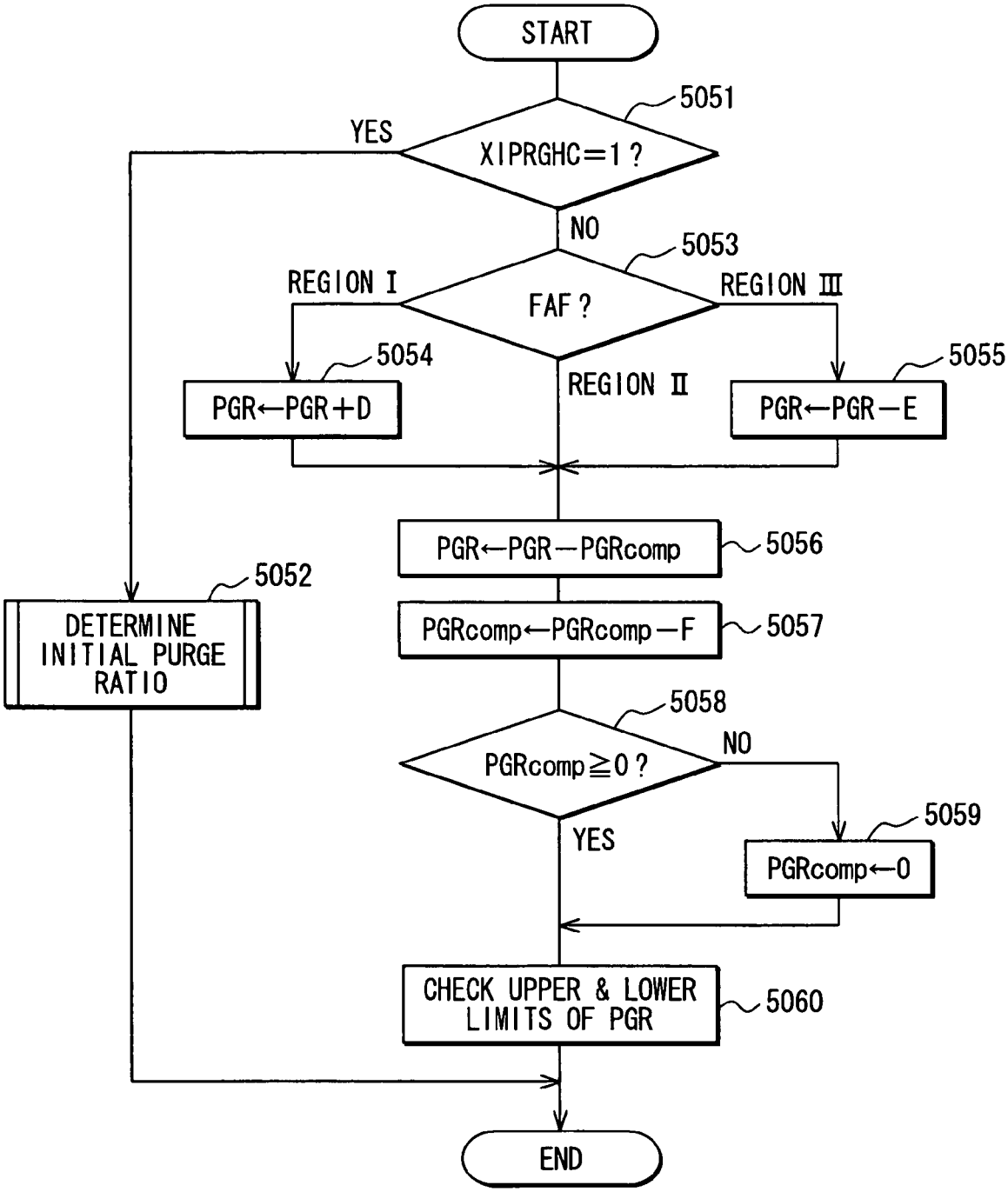
FIG. 6 is a flowchart of a normal purge ratio control processing executed in the purge ratio control routine.

FIG. 6 is a flowchart of normal purge ratio control processing executed in step 505 of the purge ratio control routine shown in FIG. 5. First, in step 5051, it is determined whether the pressure concentration detection completion flag XIPRGHC is 1. When this determination is affirmative, a purge ratio initial value determination routine is executed in step 5052.

Figure 7:
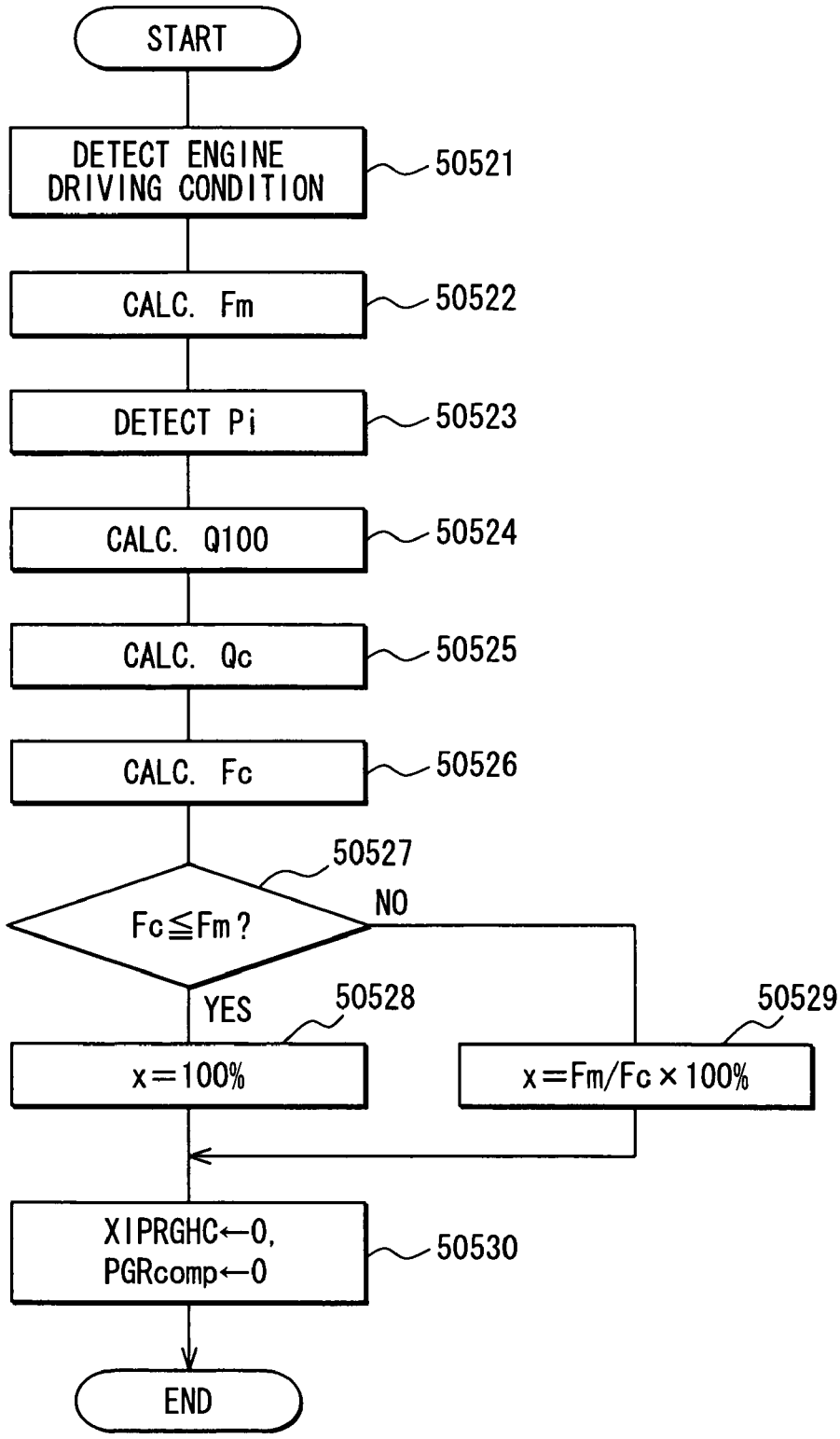
FIG. 7 is a flowchart of a purge ratio initial value determination routine.

The purge ratio initial value determination routine is shown in detail in FIG. 7. First, in steps 50521 and 50522, an allowable upper limit of a purge flow rate is set. That is, in step 50521, the operating state of the engine is detected and in step 50522, the allowance of flow rate of allowable purge fuel vapor Fm is computed on the basis of the detected operating state of the engine. The allowance of flow rate of purge fuel vapor Fm is computed on the basis the fuel injection quantity required in the operating state of the engine such as a present throttle opening, a lower limit of fuel injection quantity to be controlled by the injector 4, and the like. As the fuel injection quantity becomes larger, the ratio of the flow rate of purge fuel vapor to the fuel injection quantity becomes smaller, so also the allowance of flow rate of purge fuel vapor Fm can be allowed to a large value.

Figure 8:
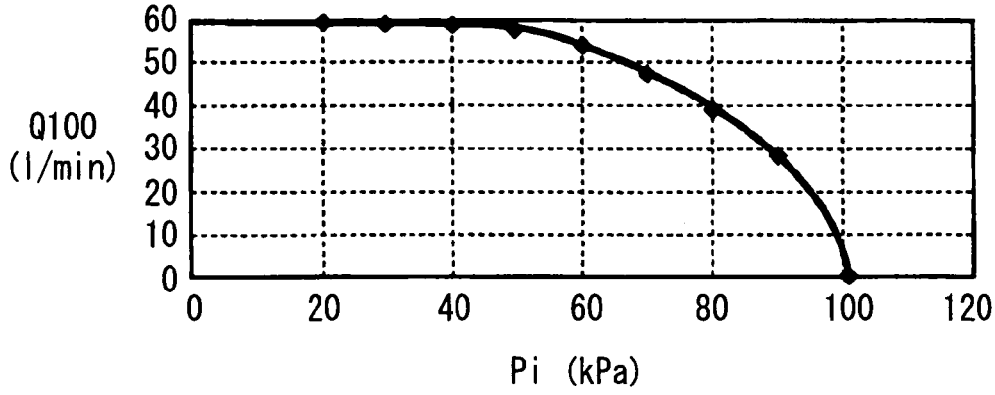
FIG. 8 is a graph to show one example of a base flow rate.

In step 50523, the present intake pipe pressure Pi is detected by an intake air pressure sensor (not shown) and in step 50524, a base flow rate Q100 is computed on the basis of the intake pipe pressure Pi. The base flow rate Q100 is the flow rate of gas of 100% air flowing in the purge line 15 when the opening of the purge valve 16 (hereinafter referred to as "purge valve opening") is 100%, and is computed according to a base flow rate map. FIG. 8 shows one example of the base flow rate map.

Figure 9:
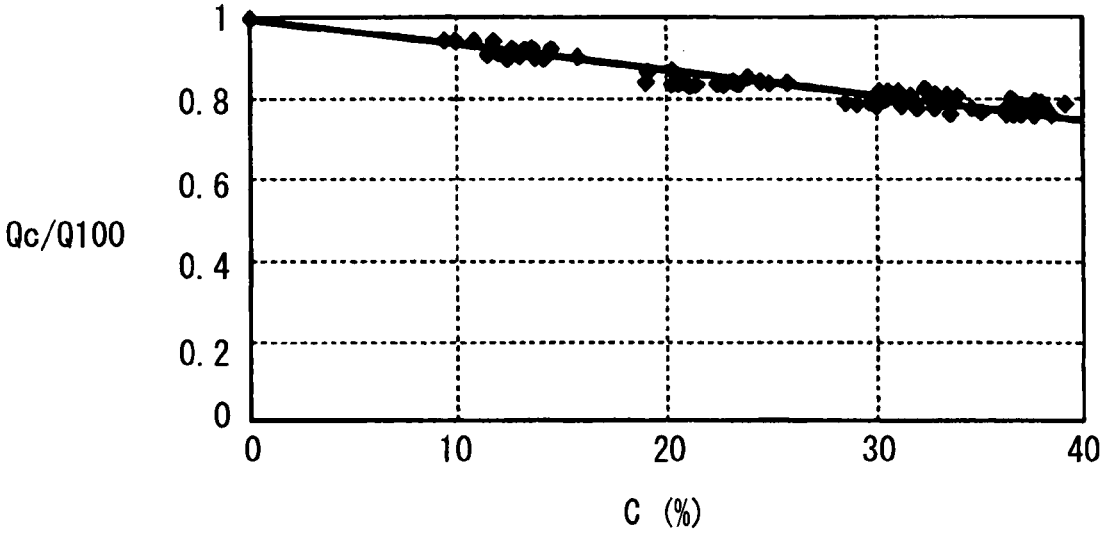
FIG. 9 is a graph to show the relationship between a fuel concentration C and a ratio (Qc/Q100) of predicted flow rate Qc to a base flow rate Q100.

In step 50525, a predicted flow rate Qc of a purge air-fuel mixture is computed by equation (3) on the basis of the fuel concentration C detected by the fuel concentration detection routine. The predicted flow rate Qc is the predicted value of purge gas flow rate when purge gas of the present fuel concentration C is flowed in the purge line 15 with the opening of the purge value set at 100%. FIG. 9 is a graph to show the relationship between fuel concentration C and the ratio (Qc/Q100) of the predicted flow rate Qc to the base flow rate Q100. As the fuel concentration C becomes larger, the density of purge gas becomes larger, so even if the intake pipe pressure Pi is the same, the flow rate becomes smaller than when purge gas is 100% air by the law of energy conservation. A straight line in the drawing is equivalent to equation (3). In the equation (3), "A" is a constant and is previously stored with control programs in the ROM of the electronic control unit.

$$Qc=Q100\times(1-A\times C) \tag{3}$$

In step 50526, the predicted flow rate of purge fuel vapor (hereinafter, referred to as "predicted flow rate of purge fuel vapor") Fc when purge gas of the present fuel concentration C is flowed in the purge line 15 with the opening of the purge valve set at 100% is computed by a following equation (4).

$$Fc=Qc\times C \tag{4}$$

In steps 50527 to 50529, a purge valve opening "x" is set. In step 50527, the predicted flow rate of purge fuel vapor Fc is compared with the allowance of flow rate of purge fuel vapor Fm and it is determined whether Fc≦Fm. When determination is affirmative, the routine proceeds to step 50528 in which the purge valve opening "x" is set at 100%. This is because even if the purge valve opening "x" is set at 100%, there is a room for the allowance of flow rate of purge fuel vapor Fm. When determination in step 50527 in which it is determined whether not FC≦Fm is negative, it is determined that when the purge valve opening "x" is 100%, air-fuel ratio control cannot be normally performed because of excessive fuel vapor, and the routine proceeds to step 50529 in which the purge valve opening "x" is set at (Fm/Fc)×100%. This is because when FC>Fm, the maximum value of purge flow rate that guarantees proper air-fuel ratio control becomes the allowance of flow rate of purge fuel vapor Fm.

When the purge valve opening "x" is computed in steps 50528 and 50529, the purge valve 16 is controlled to the computed opening.

After executing steps 50528 and 50529, in step 50530, the pressure concentration detection completion flag XIPRGHC is reset (set at 0) and a purge ratio PGRcomp to be corrected at the time of restarting purge is set at 0. By resetting the pressure concentration detection completion flag XIPRGHC in step 50530, determination in step 5051 in FIG. 6 becomes negative thereafter, so steps following step 5053 are executed.

Figure 10:
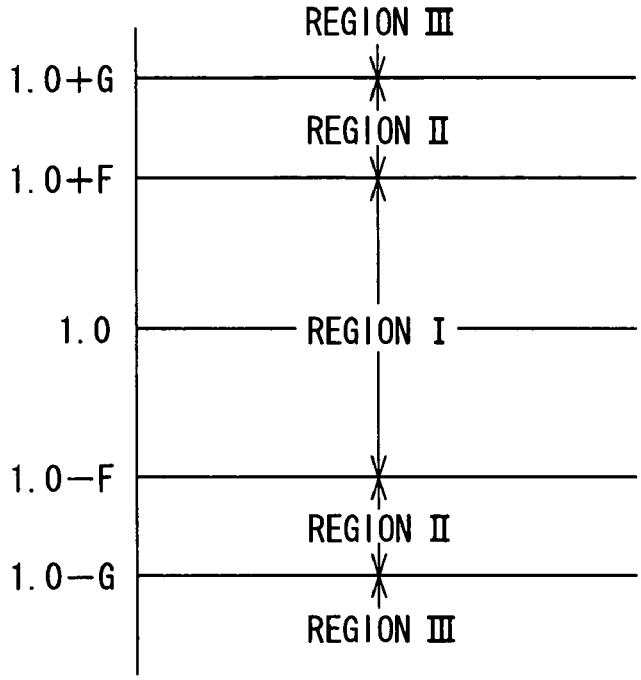
FIG. 10 is a graph to show the region of an air-fuel ratio correction factor FAF.

In step 5053, it is determined which region the air-fuel ratio correction factor FAF belongs to FIG. 10 is a graph to show the region of the air-fuel ratio correction factor FAF. When the air-fuel ratio correction factor FAF is within 1±F, the air-fuel ratio correction factor FAF belongs to a region I. When the air-fuel ratio correction factor FAF is between 1±F and 1±G, the air-fuel ratio correction factor FAF belongs to a region II. When the air-fuel ratio correction factor FAF is outside 1±G, the air-fuel ratio correction factor FAF belongs to a region III. Here, it is assumed that 0<F<G.

When it is determined in step 5053 that the air-fuel ratio correction factor FAF belongs to the region I, the routine proceeds to step 5054 in which a purge ratio PGR is increased by a previously determined purge ratio increase amount D and then the routine proceeds to step 5056. When it is determined in step 5053 that the air-fuel ratio correction factor FAF belongs to the region III, the routine proceeds to step 5055 in which a purge ratio PGR is decreased by a previously determined purge ratio decrease amount E and then the routine proceeds to step 5056. When it is determined in step 5053 that the air-fuel ratio correction factor FAF belongs to the region II, the routine proceeds directly to step 5056.

In step 5056, the purge ratio PGRcomp to be corrected at the time of restarting purge, which will be described later, is subtracted from the purge ratio PGR and the routine proceeds to step 5057. In step 5057, a previously determined value F is subtracted from the purge ratio PGRcomp to be corrected at the time of restarting purge and it is determined in step 5058 whether the purge ratio PGRcomp to be corrected at the time of restarting purge is positive.

When determination in step 5058 is negative, the purge ratio PGRcomp to be corrected at the time of restarting purge is set at a lower limit "0" in step 5059 and the routine proceeds to step 5060. When determination in step 5058 is affirmative, the routine proceeds directly to step 5060 in which the purge ration PGR is checked against the upper and lower limits thereof and this routine is finished.

Figure 11:
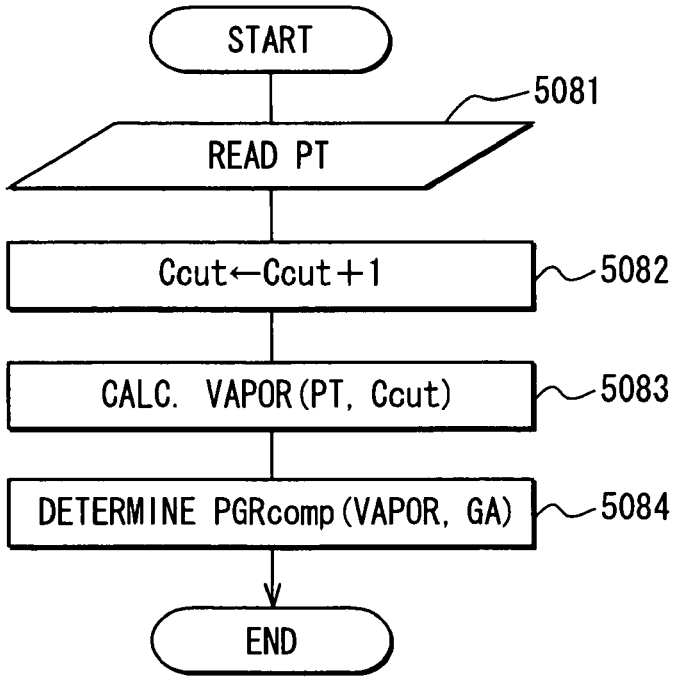
FIG. 11 is a flowchart of processing of computing a purge ratio to be corrected at the time of restarting purge which is executed in the purge ratio control routine.

FIG. 11 is a flowchart of processing of computing a purge ratio to be corrected at the time of restarting purge which is executed in step 508 of the purge ratio control routine shown in FIG. 5. First, in step 5081, a pressure PT in the fuel tank is detected by a pressure sensor (not shown) provided in the fuel tank 11. The pressure PT in the fuel tank is a function of the fuel vapor quantity in the fuel tank 11. The fuel vapor quantity in the fuel tank 11 expresses the state of balance between the evaporation of the fuel and the dissipation of the fuel into the canister 13 and the liquefaction of the fuel vapor, so the pressure PT in the fuel tank expresses the degree of evaporation of the fuel in the fuel tank 11. Here, the degree of evaporation of the fuel is roughly determined by fuel temperature and pressure applied to the surface of the fuel, so fuel temperature may be used as a factor expressing the degree of evaporation of the fuel in place of the pressure PT in the fuel tank. However, when the pressure PT in the fuel tank is used as a parameter, effects of a change in the atmospheric pressure and the like are cancelled and hence more correct measurement can be performed.

In the next step 5082, the fuel cut counter Ccut is incremented by one and the routine proceeds to step 5083. Here, the fuel cut counter Ccut expresses the time during which the state of fuel cut continues. In step 5083, a fuel vapor quantity VAPOR (PT, Ccut) absorbed by the canister 14 during the fuel cut is found as a function of the pressure PT in the fuel tank and the fuel cut counter Ccut.

As a function for finding the fuel vapor quantity VAPOR, for example, the following function can be used. That is, a fuel evaporation quantity α(PT) per unit time can be determined as a function of the pressure PT in the fuel tank, so the fuel vapor quantity VAPOR can be found by the following equation of multiplying the fuel evaporation quantity α(PT) per unit time by the count value of the fuel cut count Ccut.

$$\text{VAPOR}=\alpha(PT)\times C\text{cut}$$

In step 5084, the purge ratio PGRcomp to be corrected at the time of restarting purge is determined as a function of the fuel vapor quantity and an intake air volume GA detected by the air flow sensor, $$PGRcomp=\beta\cdot\text{VAPOR}/GA$$

where β is a factor.

Figures 12, 13:
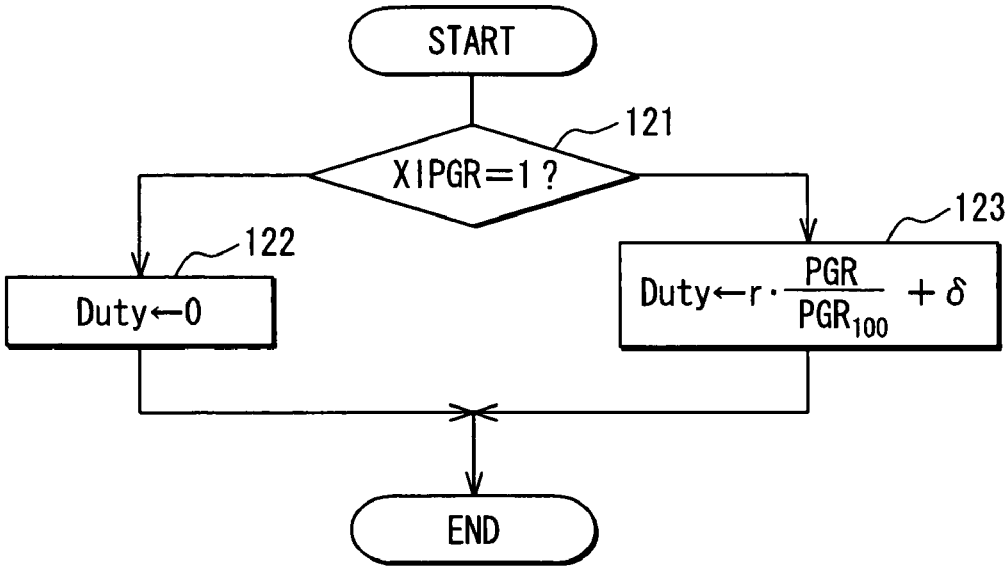
FIG. 12 is a flowchart of a purge valve driving routine.
FIG. 13 shows an example of a set map for determining a fully open purge ratio.

FIG. 12 is a flowchart of a purge control valve drive routine and the opening of the purge valve 16 is controlled by the duty ratio control. That is, it is determined in step 121 whether a purge stop flag XIPGR is "1". When determination is affirmative, it is determined that purge is stopped and a duty ratio Duty is set at 0 in step 122, and this routine is finished.

When determination in step 121 is negative, it is assumed that purge is being performed and the routine proceeds to step 123 in which a duty ratio Duty is computed by the following equation, $$\text{Duty}=\gamma\cdot PGR/PGR_{100}+\delta,$$

where $PGR_{100}$ is a fully-open purge ratio and expresses the purge quantity when the purge valve 16 is fully opened. This fully-open purge ratio $PGR_{100}$ is previously set as a map of an engine speed Ne and a throttle valve opening TA. FIG. 13 is an example of a set map for determining the fully-open purge ratio $PGR_{100}$, wherein γ and δ are correction factors determined by a battery voltage and the atmospheric pressure.

Figure 14:
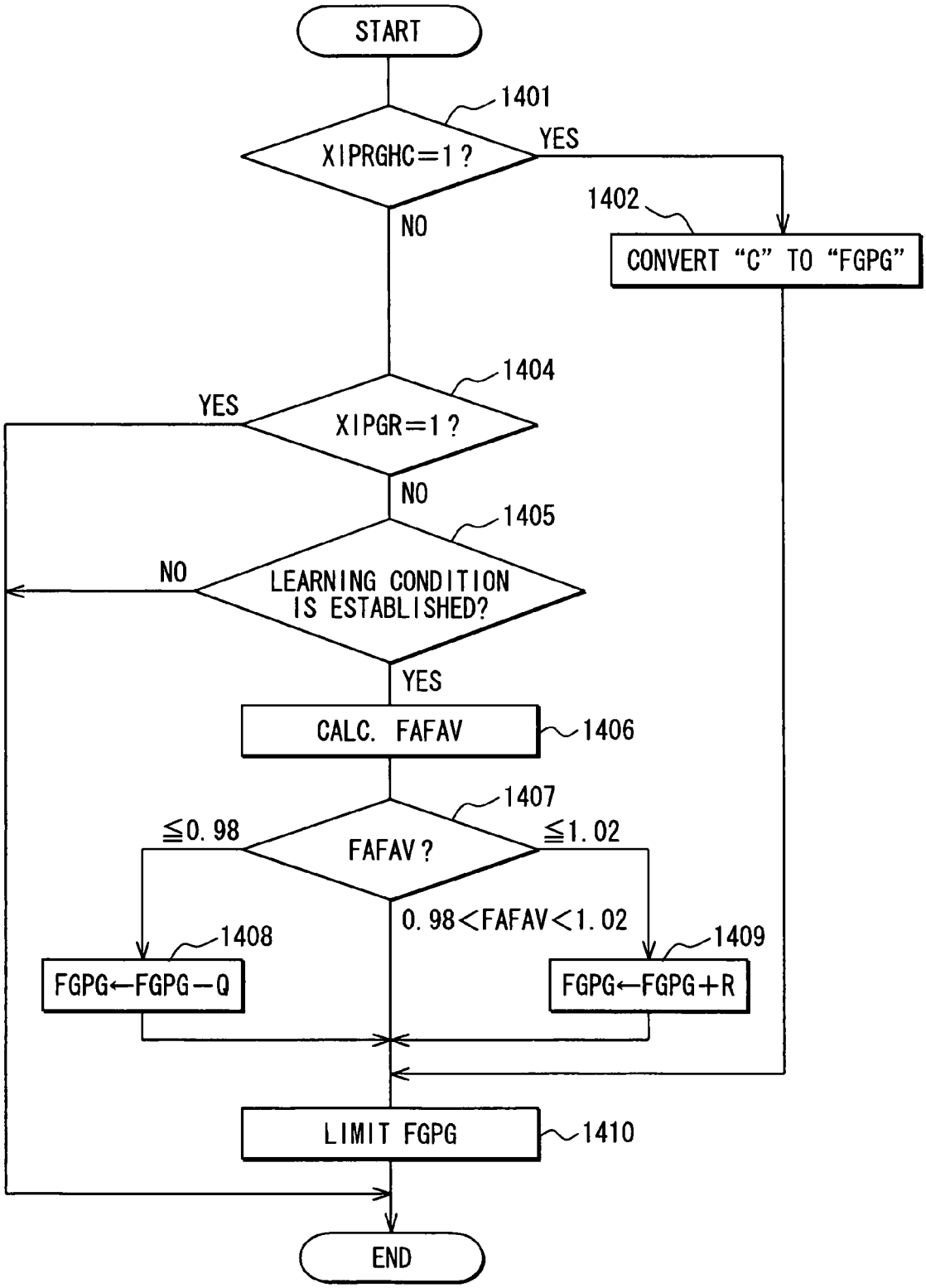
FIG. 14 is a flowchart of a fuel concentration learning routine for computing a fuel concentration FGPG.

FIG. 14 is a flowchart of a fuel concentration learning routine for computing a fuel concentration FGPG. In step 1401, it is determined whether a pressure concentration detection completion flag XIPRGHC is 1. When determination in step 1401 is affirmative, step 1402 corresponding to concentration conversion means is executed. In step 1402, by substituting the fuel concentration C determined in FIG. 4 into the following equation, the fuel concentration C is converted to a fuel concentration FGPG expressing such a relative fuel vapor concentration of purge gas as is compared with a stoichiometric air-fuel ratio (=14.6) of a target air-fuel ratio.

$$FGPG=(1-C)-(14.6\times C\times\text{density of fuel vapor/density of air})$$

Here, the density of fuel vapor and the density of air may be replaced by a previously determined constant values or may be determined on the basis of temperature.

When the ratio of fuel vapor to purge gas is the same as that of an air-fuel mixture of a stoichiometric air-fuel ratio, the above-mentioned fuel concentration FGPG becomes 0. When the ratio of fuel vapor to purge gas is larger than the stoichiometric air-fuel ratio, the fuel concentration FGPG becomes minus value. Moreover, when the ratio of fuel vapor to purge gas is smaller than the stoichiometric air-fuel ratio, the fuel concentration FGPG becomes plus value. Further, when the purge gas does not contain evaporated gas, the fuel concentration FGPG becomes 1. Hence, it can also be said that the fuel concentration FGPG expresses the degree of deviation from the stoichiometric air-fuel ratio of the purge gas. After step 1402 is executed, the routine proceeds to step 1410 to be described later.

When determination in step 1401 is negative, the routine proceeds to step 1404 in which it is determined whether the purge stop flag XIPGR is "1". When determination is affirmative, it is assumed that purge is stopped and directly this routine is finished.

When determination in step 1404 is affirmative, the routine proceeds to step 1405 in which it is determined whether fuel concentration learning conditions are satisfied. That is, when all of conditions that: (1) air-fuel feedback control is being performed, (2) cooling water temperature ≧80° C., (3) fuel increase quantity at the startup=0, and (4) fuel increase quantity at warm-up=0 are satisfied, learning is performed, and when any one of the conditions is not satisfied, learning is not performed.

When determination in step 1405 is negative, that is, learning is not performed, this routine is finished directly. When determination in step 1405 is affirmative, that is, learning is performed, the routine proceeds to step 1406. In step 1406, the time average value FAFAV of the air-fuel ratio correction factor FAF computed by the air-fuel ratio control routine in FIG. 2 is computed and the routine proceeds to step 1407.

In step 1407, it is determined which of regions of 0.98 or less, more than 0.98 and less than 1.02, and 1.02 or more the average value FAFV belongs to. When it is determined that the average value FAFV is 0.98 or less, the routine proceeds to step 1408 in which the fuel concentration FGPG is decreased by a specified amount "Q" (for example, 0.4%) and the routine proceeds to step 1410.

When it is determined that the average value FAFV is 1.02 or more, the routine proceeds to step 1409 in which the fuel concentration FGPG is increased by a specified amount "P" (for example, 0.4%) and the routine proceeds to step 1410. When it is determined that the average value FAFV is more than 0.98 and less than 1.02, the fuel concentration FGPG is not updated but the routine directly proceeds to step 1410. The steps 1406 to 1409 correspond to first means for determining a fuel concentration, that is, first fuel state determination means.

In this regard, when the fuel vapor concentration of purge gas is "0", the fuel concentration FGPG determined by executing step 1408 or step 1409 is set at "1", and as the fuel concentration becomes larger, the fuel concentration FGPG becomes a value smaller than 1. In step 1410, the fuel concentration FGPG is limited to a value within specified upper and lower values and this routine is finished.

Figure 15:
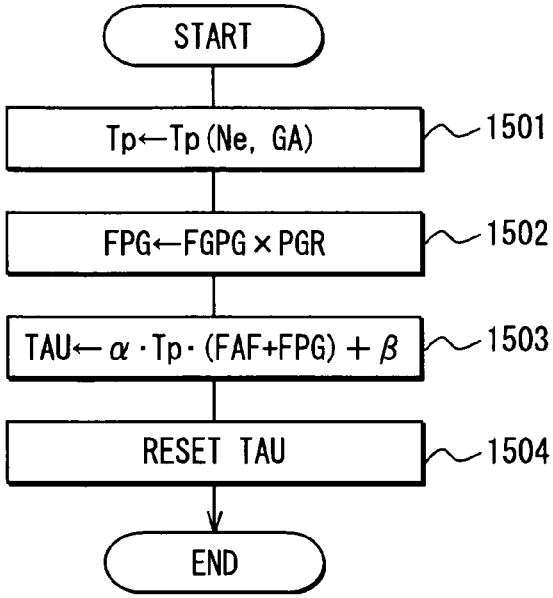
FIG. 15 is a flowchart of an injector control routine.

FIG. 15 is a flowchart of an injector control routine. First, in step 1501, a base fuel injection time Tp is found as a function of an engine speed Ne and an intake air volume GA.

$$Tp=Tp(Ne, GA)$$

In the next step 1502, a purge correction factor FPG is computed on the purge ratio PGR and the fuel concentration FGPG determined by FIG. 14.

$$FPG=FGPG\cdot PGR$$

In step 1503, an injector valve opening time TAU is determined by the following equation using the air-fuel ratio correction factor FAF computed by the air-fuel ratio control routine shown in FIG. 2 and the purge correction factor FPG.

$$TAU=\alpha\cdot Tp\cdot(FAF+FPG)+\beta$$

where α and β are correction factors including a warm-up increase amount and a startup increase amount.

In step 1504, the injector valve opening time TAU is outputted and this routine is finished.

Figure 16:
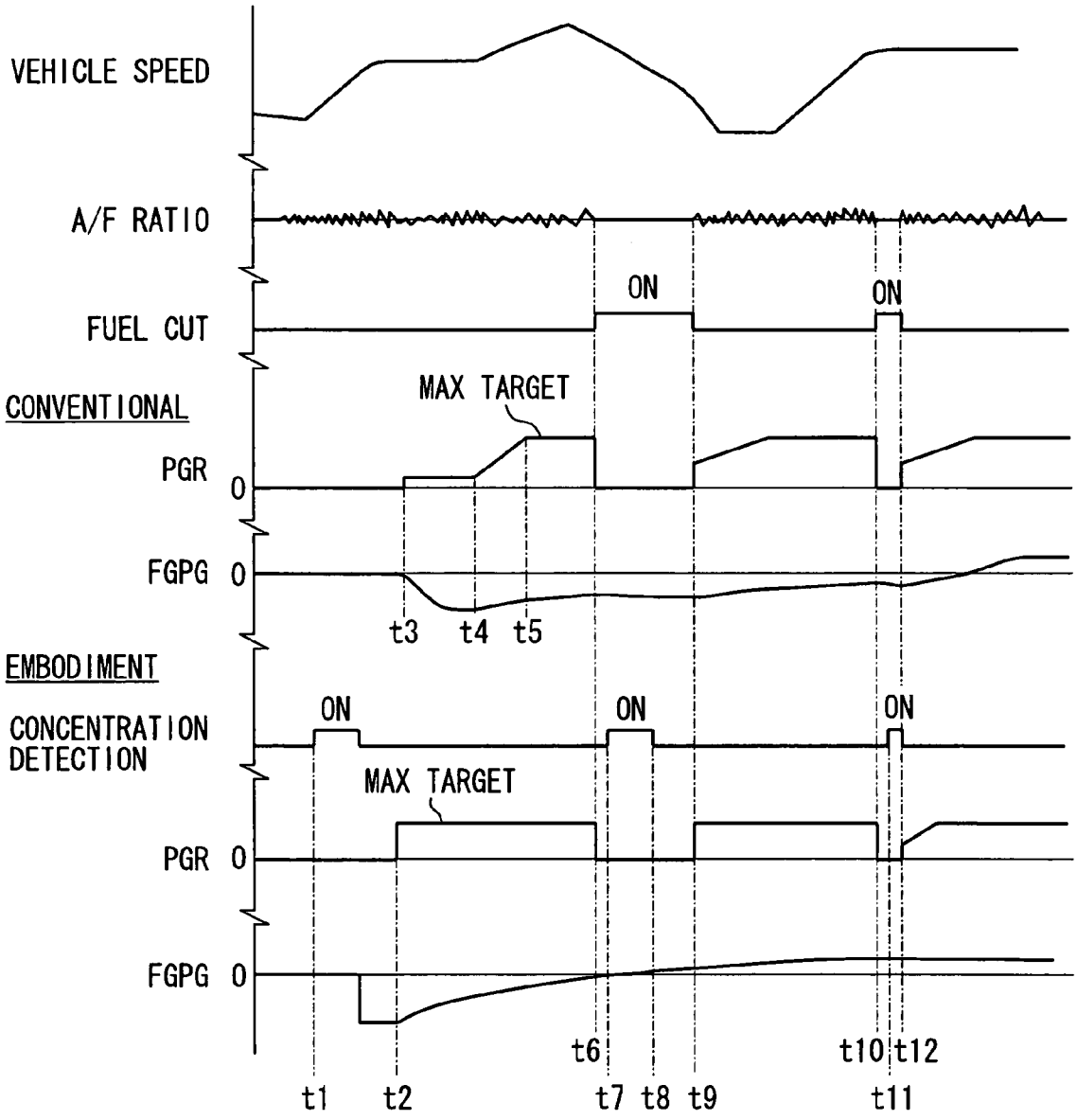
FIG. 16 is a timing chart in which purge timing is compared between this embodiment and a related art.

FIG. 16 is a timing chart in which purge timing is compared between this embodiment and a conventional system.

When determinations in steps 301 to 303 in FIG. 3 are affirmative, for example, an ignition switch is turned on, the detection of fuel concentration based on pressure measurement (FIG. 4) is started (timing t1). When the detection of fuel concentration in FIG. 4 is finished to acquire the fuel concentration C, the fuel concentration C can be converted to a relative fuel vapor concentration, that is, the fuel concentration FGPG in step 1402 in FIG. 14. Moreover, the pressure concentration detection completion flag XIPRGHC becomes 1 and the purge ratio PGR is set at the maximum target purge ratio (for example, 10% to 20%) in step 5052 in FIG. 6, so the purge valve 16 is fully opened to start purging (timing t2).

On the other hand, in the prior art, the fuel concentration FGPG cannot be known before purging is started, so purging needs to be started at as a small purge ratio PGR as does not affect the air-fuel ratio (timing t3). A fuel concentration FGPG when the purge ratio PGR is brought to the maximum target purge ratio is predicted from the small purge ratio PGR. Further, after the timing (timing t4) when the prediction is completed, to prevent the disturbance of the air-fuel ratio, it is necessary to repeat the learning of the fuel concentration FGPG on the basis of the predicted value and to open the purge valve 16 gradually. Hence, it is timing t5 that the purge ratio PGR can be brought to the maximum target purge ratio.

When a vehicle speed is brought to the state of deceleration to bring about a state in which fuel cut is ON (timing t6), the purge ratio PGR is brought to 0, that is, there is brought about a state in which the purge valve 16 is totally closed to interrupt purge. When a specified time elapses in a state in which purge is held interrupted after the last detection of the fuel concentration based on pressure measurement is completed, in this embodiment, all of determinations in steps 301 to 303 in FIG. 3 become affirmative, so the detection of the fuel concentration based on pressure measurement is again started (timing t7). When the detection of the fuel concentration based on pressure measurement is completed at timing t8, the pressure concentration detection completion flag XIPRGHC is set at 1 in step 502 in FIG. 5 and the fuel concentration FGPG is computed in step 1402 in FIG. 14.

When there is brought about a state in which the fuel cut is off, that is, fuel cut is released at timing t9 after timing t8, the fuel concentration FGPG is computed in step 1402 in FIG. 14. The purge can be restarted with the purge ratio PGR set at the maximum target purge ratio from the timing (timing t9) when purge is restarted.

In contrast to this, in the prior art, the period of a state in which the fuel cut is ON is integrated to increase the purge ratio PGR to some degree when purge is restarted to a certain level, but the purge ratio PRG cannot be brought to the maximum target purge ratio. Hence, in order to prevent the air-fuel ratio from being disturbed, it is necessary to repeat the learning of the fuel concentration FGPG and at the same time to increase the purge ratio PGR.

Moreover, when there is brought about a state in which the fuel cut is ON at timing t10 and the detection of concentration based on pressure measurement is started at timing t11. When the fuel cut returns to being OFF at timing t12 without the detection of concentration being not completed, the purge is restarted at the purge ratio PGR determined by integrating the period of a state in which the fuel cut is ON.

In this manner, comparing the operation of this embodiment with the operation of the conventional system, at the time of startup of purge, in the prior art, an initial purge ratio PGR needs to be reduced to as small a value as does not affect the air-fuel ratio. In contrast to this, in this embodiment, purge can be started from the startup of purge (at timing t2) with the purge ratio PGR set at the maximum target purge ratio, so the amount of purge can be made larger in this embodiment.

Moreover, in the prior art in which the fuel concentration FGPG is determined from the deviation of the air-fuel ratio when purge is actually performed, a change in the fuel concentration FGPG cannot be detected in the course of interrupting purge. For this reason, when the fuel cut is rendered ON to interrupt purge and then purge is restarted, it is necessary to set the purge ratio PGR when purge is restarted smaller than the maximum target purge ratio and then to increase the purge ratio. PGR gradually. In contrast to this, in this embodiment, the fuel concentration FGPG can be acquired in the course of interrupting purge, so the purge ratio PGR when purge is restarted (at timing t9) can be set at the maximum target purge ratio. Thus, in this embodiment, also the amount of purge when the purge is restarted can be increased.

Here, in this embodiment, when the detection of the fuel concentration is not completed in the course of interrupting purge, like the prior art, the purge ratio PGR when purge is restarted is determined on the basis of the time during which purge is interrupted. Hence, even if the detection of the fuel concentration is not completed in the course of interrupting purge, the amount of purge does not become smaller than in the prior art.

In the above-mentioned embodiment, the pressure sensor 24 has its one end connected to the downstream side of the orifice 23 and has its other end opened to the atmosphere. However, it is also recommendable to detect a differential pressure across the orifice 23 by connecting the other end of the pressure sensor 24 to the upstream side of the orifice 23.

Moreover, while the three-position valve 21 is employed in the above-mentioned embodiment, it is also possible to use a plurality of two-position valves in combination and to perform a switching operation corresponding to the above-mentioned first position to third position.

Second Embodiment

The construction of a fuel vapor treatment apparatus is the same as that in the first embodiment. In a second embodiment, the following flowchart is further executed.

Figure 17:
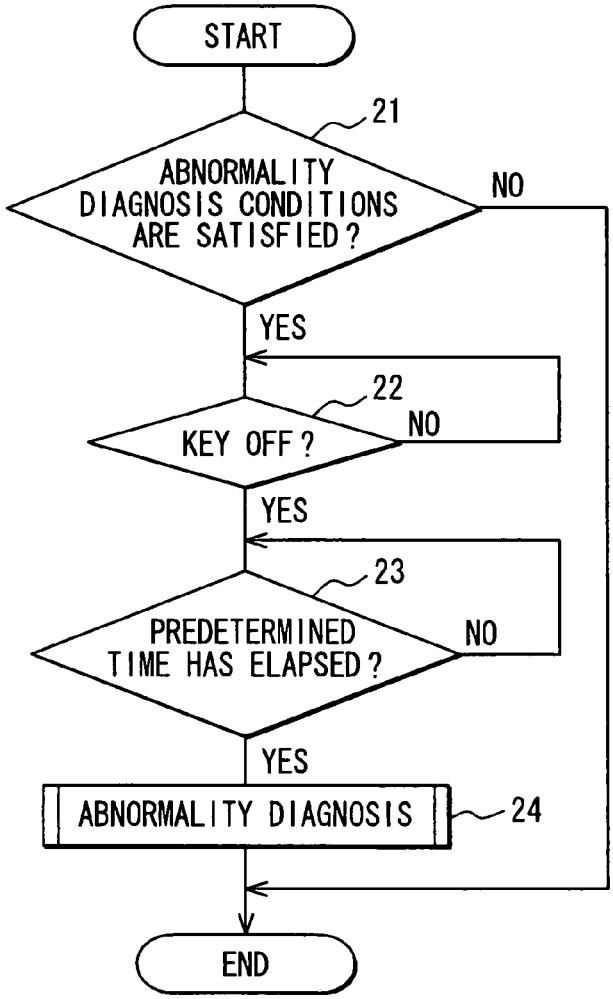
FIG. 17 is a flowchart to show an abnormality diagnosis control for diagnosing a leak and an abnormality in a fuel concentration detection system of a fuel vapor treatment apparatus.

FIG. 17 is a flowchart to show abnormality diagnosis control for making a diagnosis of a leak and an abnormality of a fuel concentration detection system of a fuel vapor treatment apparatus. Here, the fuel concentration detection system means paths and devices through which gas passes in FIG. 4 (fuel concentration detection routine based on pressure measurement). In this embodiment, processing shown in FIG. 17 corresponds to abnormality detection means and in this processing, the three-way valve 21 and the switching valve 18 function as a closed space forming valve and pressure application range switching means, the measurement line 22 functions as a leak inspection passage, and the pump 26 functions as pressure application means.

In step 21, it is determined whether abnormality diagnosis conditions are satisfied. It is assumed that the abnormality diagnosis conditions (that is, leak diagnosis conditions) are satisfied when the time during which the vehicle is operated continues for a specified period of time or more or when outside temperature is a specified temperature or more. When determination in step 21 is negative, this routine is finished. When determination in step 21 is affirmative, it is determined in step 22 whether the key is OFF. When determination in step 22 is negative, step 22 is repeated to wait for the key to be turned OFF.

When determination in step 22 where it is determined whether the key is OFF is affirmative, the routine proceeds to step 23 in which it is determined whether a specified time period elapses from the time when the key is turned OFF. Step 23 is the processing of preventing making a diagnosis immediately after the key is turned OFF. Because immediately after the key is turned OFF, the pressure in the fuel vapor treatment apparatus is unstable and the fuel in the fuel tank 11 is swung or the fuel temperature is unstable and hence it is not suitable to make a diagnosis of a leak and an abnormality. The specified period of time is a period of time, which elapses after the state in the fuel vapor treatment apparatus becomes unstable immediately after the key is turned OFF until the state become as stable as a leak diagnosis can be made correctly, and is previously set. When determination in step 23 is negative, step 23 is repeated, and when determination in step 23 becomes affirmative after the specified time elapses, a diagnosis of an abnormality is made in step 24 and then this routine is finished.

Figure 18:
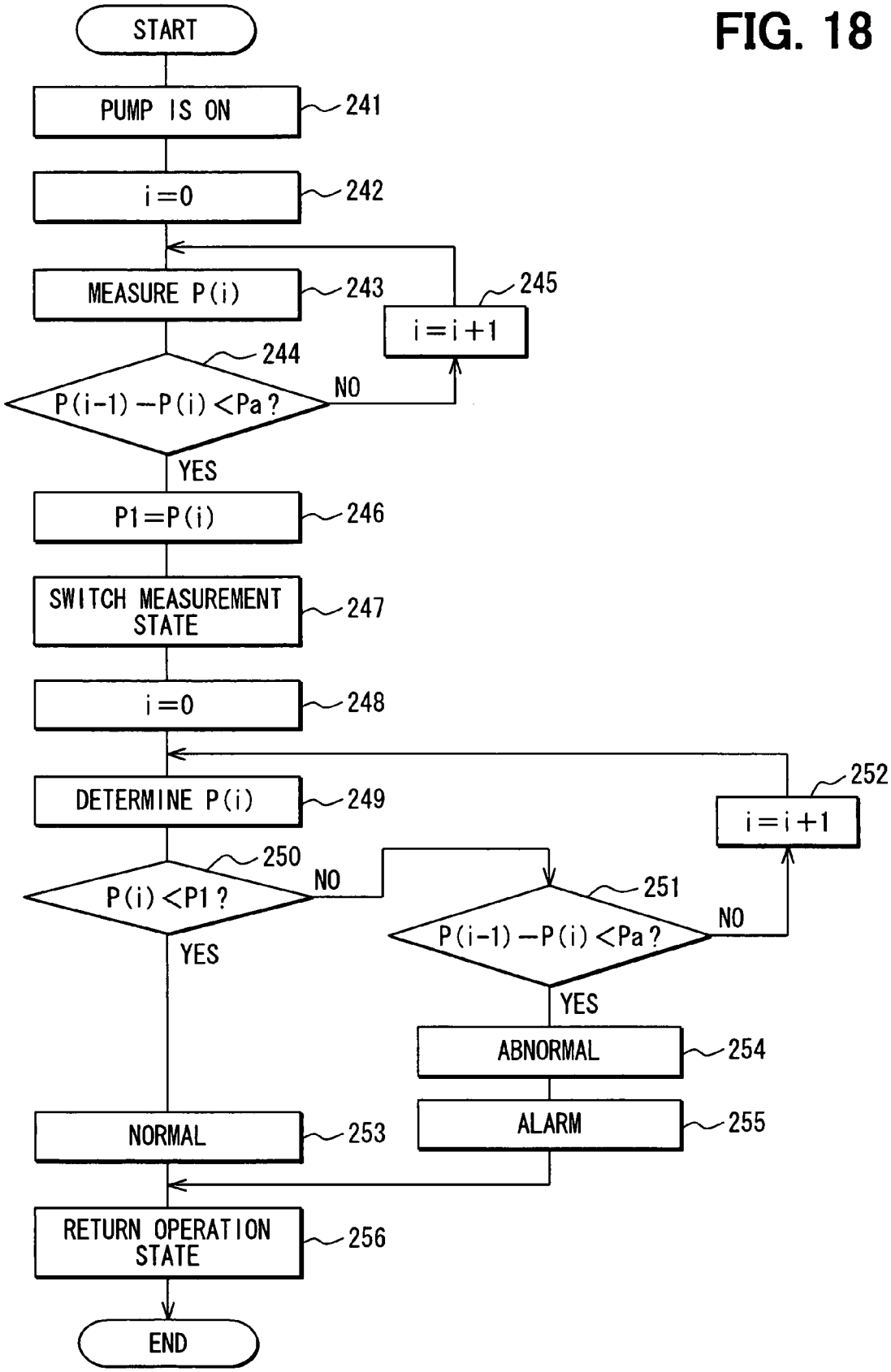
FIG. 18 is a flowchart to show an abnormality diagnosis routine.

In FIG. 18 is shown an abnormality diagnosis routine. When the abnormality diagnosis routine is started, the three-position valve 21 is set at the first position and the switching valve 18 is set at the first position. At this time, pressure detected by the pressure sensor 24 of a differential pressure sensor is 0.

Figure 19:
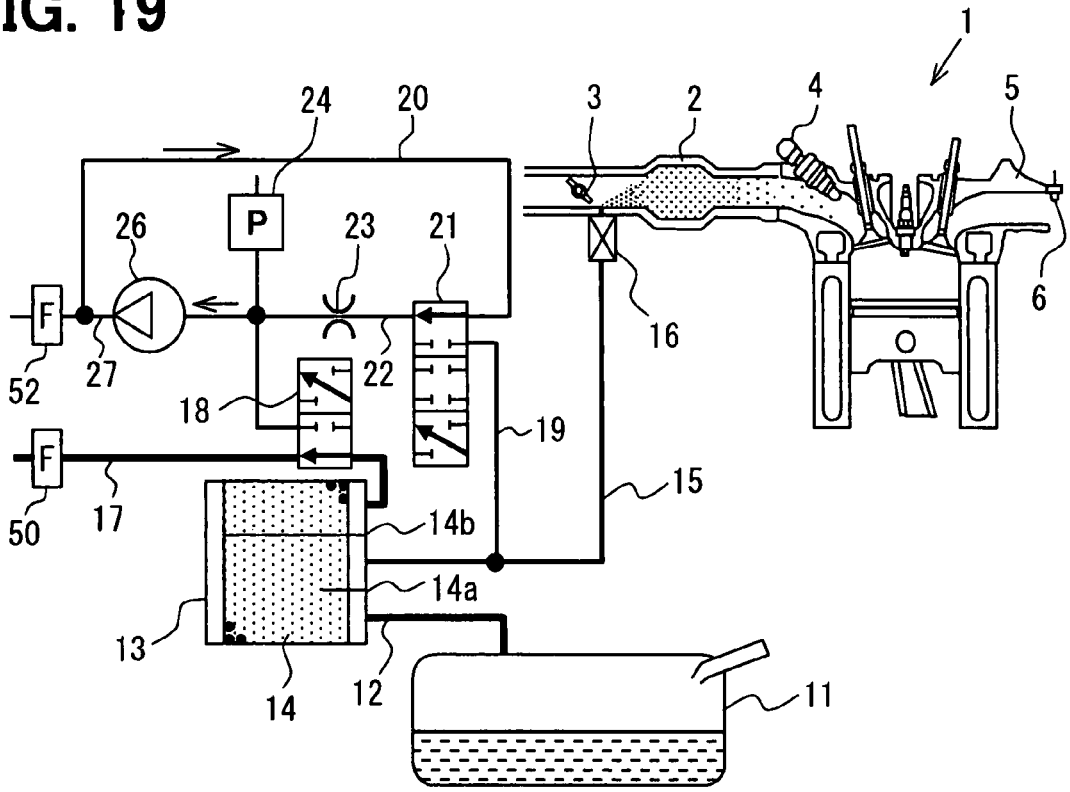
FIG. 19 is a diagram to show a state in which gas flows at the time of executing step in FIG. 18.

In step 241, the pump 26 is operated. The state of flow of the gas is shown in FIG. 19. The state shown in FIG. 19 is the same as the above-mentioned first measurement state. As shown in FIG. 19, in the state in step 241, the three-position valve 21 is set at the first position, so the air supply line 20 communicating with the atmosphere communicates with the measurement line 22 and the switching valve 18 is set at the first position, so the canister 13 does not communicate with the pump 26. Hence, the state in step 241 is an air flow state in which air passes through the measurement line 22 and hence the pressure detected by the pressure sensor 24 is a pressure drop of air by the restrictor 23.

In step 242, a variable i is set at 0. In the subsequent step 243, the pressure detected by the pressure sensor 24 is measured as pressure P(i). In step 244, a change (P(i−1)−P(i)) from the last measured pressure P(i−1) to this measured pressure P(i) is compared with a threshold Pa and it is determined whether (P(i−1)−P(i))<Pa.

When determination in step 244 is negative, the variable i is increased by 1 and the routine returns to step 243. When determination in step 244 is affirmative, and the routine proceeds to step 246. That is, the measured pressure shows a behavior that changes greatly when the pump 26 starts to operate and then converges gradually on a pressure value determined by the passage sectional area of the restrictor 23 and the like, so processing following step 246 is executed after the measured pressure converges sufficiently.

Figure 20:
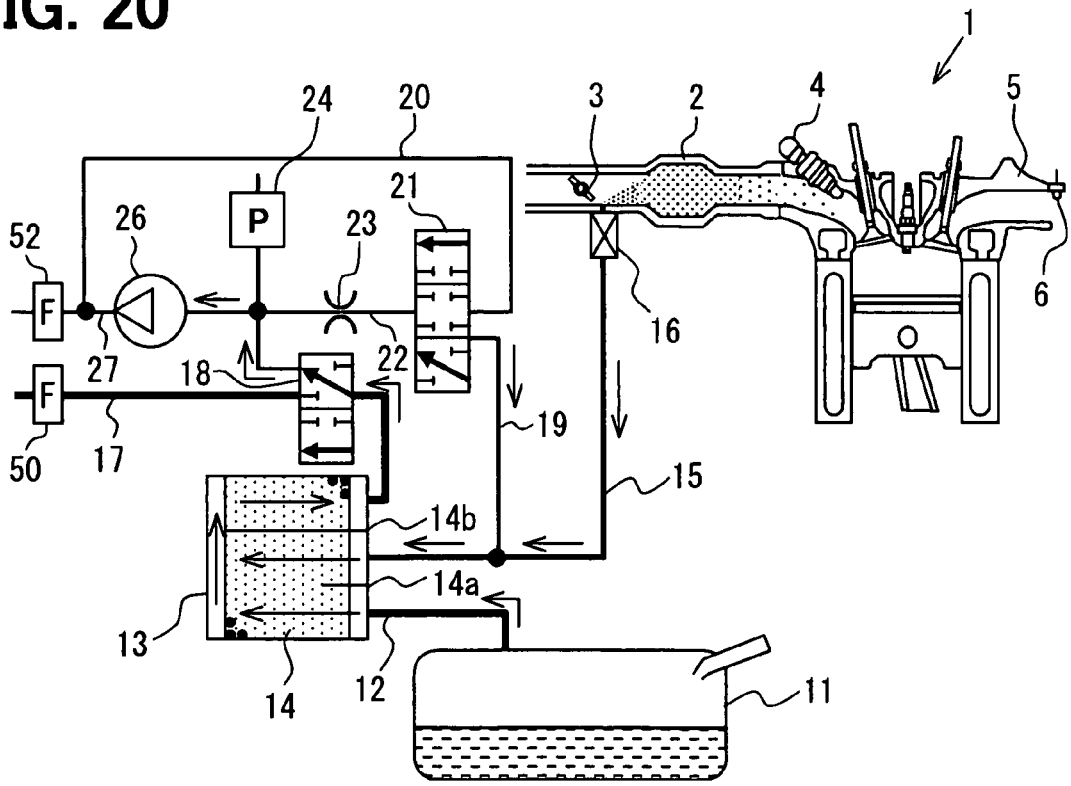
FIG. 20 is a diagram to show a state in which gas flows at the time of executing step in FIG. 18.

In step 246, P(i) is substituted for the reference pressure P1. Then, in step 247, the state of measurement is switched to the state of leak measurement. This state of leak measurement is the state, shown in FIG. 20, in which the three-position valve 21 is set at the second position and in which the switching valve 18 is set at the second position. Here, when an abnormality diagnosis is conducted, the key is OFF and hence also the purge valve 16 is closed.

In this state of leak measurement, the fuel tank 11, the evaporator line 12, the canister 13, the purge line 15, the branch line 19, and a passage from the canister 13 to the pump 26 via the switching valve 18 constructs a closed space. For this reason, gas in the closed space is dissipated to the atmosphere by the pump 26, whereby pressure in the closed space is decreased.

Steps 248 to 255 are processing for determining the presence or absence of abnormalities in the closed space by comparing the measured pressure with the reference pressure P1. The abnormalities in the closed space include not only an abnormality that a leak aperture is formed in the closed space, that is, an abnormality in the line included in the closed space but also an abnormality of the other devices included in the closed space, for example, the faulty switching of the three-position valve 21 and the switching valve 18. This is because if an abnormality is not in the closed space, pressure on which pressure in the closed space in a state in which pressure is reduced converges is determined by the area of the aperture of the restrictor 23. If a leak aperture is formed in the closed space or a faulty switching of the three-position valve 21 or the switching valve 18 occurs, a completely closed space is not formed and hence the pressure does not reach the reference pressure P1.

In step 248, the variable i is set at 0. In step 249, the pressure P(i) is measured and in step 250, the measured pressure P(i) is compared with the reference pressure P1 and it is determined whether P(i)<P1. When this determination is affirmative, the routine proceeds to step 253, and when the determination is negative, the routine proceeds to step 254. At the beginning when the state of measurement is switched to the state of leak measurement, normally, the measured pressure P(i) does not reach the reference pressure P1 and hence determination in step 250 is negative.

When determination in step 250 is negative, the routine proceeds to step 251. Steps 251, 252 are processing of the same purport as steps 244, 245. In step 251, a change (P(i−1)−P(i)) from the last measured pressure P(i−1) to this measured pressure P(i) is compared with a threshold Pa and it is determined whether (P(i−1)−P(i))<Pa. When determination in step 251 is negative, the variable i is increased by 1 in step 252 and the routine returns to step 249. When the determination in step 251 is affirmative, the routine proceeds to step 254. The purport of step 251 is to wait the measured pressure P(i) to converge as in the case of the above-mentioned step 244.

In step 253, it is determined that the closed space is normal. In step 254, it is determined that the closed space is abnormal. When a leak aperture larger than the restrictor 23 exists in the closed space, it is determined that the closed space is abnormal. However, not only in the case where a leak aperture larger than the restrictor 23 exists in the closed space but also in the case where the closed space is not formed by the faulty switching of the three-position valve 21 and the switching valve 18, it is determined that the closed space is abnormal.

When step 253 is executed and it is determined that the closed space is normal, the routine proceeds to step 256. On the other hand, when step 254 is executed and it is determined that the closed space is abnormal, step 255 for operating alarm means is executed and then the routine proceeds to step 256. The alarm means is, for example, an indicator provided on the instrument panel of the vehicle.

In step 256, the pump 26 is stopped and both of the three-position valve 21 and the switching valve 18 are set at the first positions to return the operation to a state before making an abnormality diagnosis.

Figure 21:
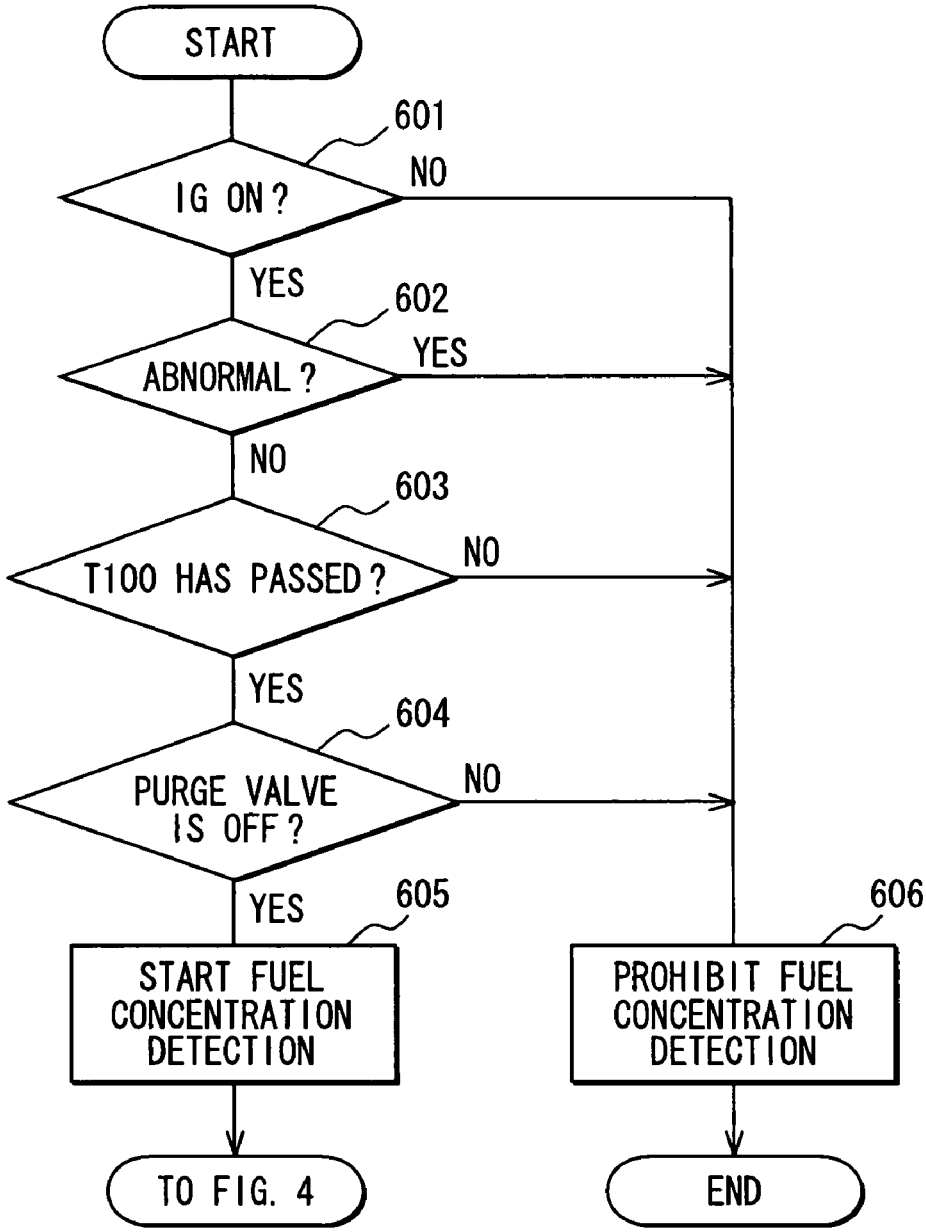
FIG. 21 is a flowchart to show a fuel concentration determination routine for determining a fuel vapor concentration in purge gas purged from the canister.

FIG. 21 is a flowchart to show a fuel concentration determination routine for determining a fuel vapor concentration in purge gas purged from the canister 13 and the fuel concentration determination routine is executed at intervals of a specified short period.

In step 601, it is determined whether the ignition switch is ON. When this determination is negative, the engine 1 is not operated, so purge control is not performed. Hence, in step 606, it is determined that the detection of fuel concentration based on pressure measurement (FIG. 4) is prohibited and this routine is finished.

On the other hand, when determination in step 601 is affirmative, step 602 is executed to further determine whether it is determined in the above-mentioned abnormality diagnosis control (FIG. 17) that the fuel concentration detection system is abnormal. When determination in this step 602 is affirmative, that is, when an abnormality is detected in the closed space shown in FIG. 20, step 606 is executed to prohibit the detection of fuel concentration based on pressure measurement (FIG. 4).

This is because a pressure drop by the restrictor 23 of the air-fuel mixture (pressure P1 of the air-fuel mixture flow) purged from the canister 13 is measured in step 402 in FIG. 4. For this reason, the purge valve 16 is closed in step 402 in FIG. 4, but when a leak aperture is formed in the evaporation line 15 and in the branch line 19, outside air flows into from the leak aperture to decrease the fuel concentration of the air-fuel mixture, thereby making it difficult to detect the correct fuel concentration. Moreover, also when the three-position valve 21 is not switched correctly and the air-fuel mixture is not introduced correctly into the restrictor 23 and hence an abnormality is detected in the closed space, there is a high possibility that the pressure P1 of the air-fuel mixture flow in step 402 cannot be measured correctly. Hence, the detection of fuel concentration (FIG. 4) based on pressure measurement is prohibited.

When determination in step 602 is negative, that is, when it is diagnosed that the fuel concentration detection system is normal, the routine proceeds to step 603. In step 603, it is further determined whether a specified period T100 has passed after the last detection of fuel concentration, that is, the detection of fuel concentration based on FIG. 4. When determination in step 603 is negative, the above-mentioned step 606 is executed.

When determination in step 603 is affirmative, it is further determined in step 604 whether the purge valve 16 is turned off, that is, is totally closed. When determination in this step 604 is negative, that is, also when the purge valve 16 is opened, the above-mentioned step 606 is executed.

When determination in step 604 is affirmative, it is determined in step 605 that the detection of fuel concentration based on pressure measurement is started and the routine proceeds to FIG. 4.

When abnormality diagnosis conditions are satisfied in FIG. 16 while the engine is stopped, abnormality diagnosis control (FIG. 17) is performed in advance. An example of a time chart when the diagnosis result is abnormal is a time chart showing the conventional control in FIG. 16. An example of a time chart when the diagnosis result is normal is a time chart showing the embodiment in FIG. 16.

If the diagnosis result is normal, when determinations in steps 601 to 603 in FIG. 21 are affirmative, for example, when the ignition switch is turned on, the detection of fuel concentration based on pressure measurement (FIG. 4) is started (timing t1).

When the detection of fuel concentration in FIG. 4 is finished to acquire a fuel concentration C, the fuel concentration C can be converted to the relative fuel vapor concentration, that is, the fuel concentration FGPG in step 1402 in FIG. 14. Moreover, the pressure concentration detection completion flag XIPRGHC becomes 1, so purge ratio initial value determination processing in step 5052 in FIG. 6 is performed. For this reason, the purge ratio is brought to a large purge ratio PGR determined by performing the purge ratio initial value determination processing and then purge is started (timing t2).

On the other hand, when the diagnosis result is abnormal, purge is started at as small a purge ratio PGR as does not affects the air-fuel ratio (timing t3). A fuel concentration FGPG when the purge ratio PGR is further enlarged from this small purge ratio PGR is predicted. Further, from after the prediction is completed (timing t4), the purge valve 16 is gradually opened while the fuel concentration FGPG is repeatedly learned on the basis of the predicted values, and at timing t5, the purge ratio PGR reaches a maximum value. With this, even if the fuel concentration FGPG cannot be known before starting purge, it is possible to perform purge while preventing the air-fuel ratio being disturbed.

When the vehicle speed is brought to a state of deceleration to bring about a state in which fuel cut is ON (timing t6), the purge ratio PGR is brought to 0, that is, there is brought about a state in which the purge valve 16 is totally closed to interrupt purge. When a specified period of time elapses in a state of interrupting purge after the last detection of the fuel concentration based on pressure measurement is completed, in a case where the diagnosis result is normal, all of determinations in steps 601 to 604 in FIG. 21 become affirmative. The detection of the fuel concentration based on pressure measurement is started again (timing t7). When the detection of the fuel concentration is completed at timing t8, the pressure concentration detection completion flag XIPRGHC is set at 1 in step 502 in FIG. 5 and the fuel concentration FGPG is computed in step 1402 in FIG. 14.

When there is brought about a state in which fuel cut is OFF, that is, when fuel cut is released at timing t9 after timing t8, the fuel concentration FGPG is computed in step 1402 in FIG. 14, so purge is started again at a large purge ratio PGR from the time when purge is started again (timing t9).

On the other hand, in a case where the diagnosis result is abnormal, purge is started again at a purge ratio PGR determined on the basis of a period of time during which fuel cut is ON. With this, purge can be started again without disturbing the air-fuel ratio. After purge is started again, the fuel concentration FGPG is learned repeatedly and at the same time the purge ratio PGR is increased.

Moreover, when the fuel cut is rendered ON at timing t10 and the detection of fuel concentration based on pressure measurement is started at timing t11 and the fuel cut is rendered OFF at timing t12 without the detection of fuel concentration being completed, even in a case where the diagnosis result is normal, as is the case where the diagnosis result is abnormal, purge is started again at a purge ratio PGR determined by integrating the period of time during which the fuel cut is ON.

Thus, in this embodiment, in a case where the fuel concentration detection system is normal, purge can be started at the maximum purge ratio PGR from the time when purge is started (timing t2), and the purge ratio PGR can be set at the maximum purge ratio PGR also when purge is started again (timing t9). Thus, the amount of purge can be increased sufficiently.

Moreover, in a case where the detection of fuel concentration is not completed in the course of interrupting purge, the purge ratio PGR when purge is started again is determined on the basis of the period of time during which purge is interrupted. Even if the detection of fuel concentration is not completed in the course of interrupting purge, the purge ratio PGR when purge is started again can be increased to some extent. This can also increase the amount of purge.

In addition, in a case where it is diagnosed in the abnormality diagnosis control in FIG. 17 that the fuel concentration detection system is abnormal, the detection of fuel concentration by that fuel concentration detection system (FIG. 4) is not performed. The fuel concentration FGPG (first fuel concentration) determined on the basis of the amount of deviation from the target air-fuel ratio of the air-fuel ratio in FIG. 2 is used irrespective of the operating state of the vehicle. It is also possible to prevent that the fuel injection quantity is controlled on the basis of the abnormal fuel concentration to deviate the air-fuel ratio from the target air-fuel ratio.

In the above-mentioned embodiment, the closed space formed for diagnosing an abnormality is formed by closing the purge valve 16, by setting the three-position valve 21 at the second position, and by setting the switching valve 18 at the second position. However, the closed space has only to include a path in which the air-fuel mixture flows in the detection of fuel concentration based on pressure measurement or a portion of a path communicating with the path. This is because it can be determined in this case that it is a high possibility that when the closed space is abnormal, the pressure P1 of the air-fuel mixture flow cannot be measured correctly. Thus, for example, it is also recommendable to form the closed space by holding the purge valve 16 and the switching valve 18 set in the same manner as in the above-mentioned embodiment and by setting the three-position valve 21 at the third position (position where the branch line 19 communicates with the measurement line 22). Moreover, it is also recommendable to form the closed space by setting the three-position valve 21 at the second position (position where the measurement line 22 communicates with neither the air supply line 20 nor the branch line 19) and by setting the switching valve 18 at the first position (position where the measurement line 22 is interrupted from the canister 13 and a standby line 17).

Moreover, it is also recommendable to diagnose an abnormality in the fuel concentration detection system on the basis of the pressure P when the closed space is formed and of whether the pressure P is decreased to a predetermined determination value or less. This is because when the pressure P is not decreased to the determination value or less, it can be thought that abnormalities such as a decrease in the capacity of the pump 26, a faulty switching operation of the switching valve 18 and the three-position valve 21, and a leak occur.

Further, it is also recommendable to provide a position sensor for detecting the positions of the switching valve 18 and the three-position valve 21 and to diagnose an abnormality in the switching valve 18 and the three-position valve 21 on the basis of a signal from the position sensor.

What is claimed is:

1. A fuel vapor treatment apparatus for an internal combustion engine, comprising:

a canister that temporarily adsorbs fuel vapor developed in a fuel tank;

a purge pipe that introduces the fuel vapor purged from the canister into an intake pipe of the internal combustion engine;

a purge control valve that is arranged in the purge pipe and controls a purge flow rate from the purge pipe to the intake pipe;

an air-fuel ratio sensor that is provided in an exhaust pipe of the internal combustion engine and measures an air-fuel ratio;

a first fuel state determination means that determines a state of fuel of an air-fuel mixture containing the fuel vapor purged from the canister on the basis of an amount of deviation from a target air-fuel ratio of an air-fuel ratio detected by the air-fuel ratio sensor when the purge control valve is opened; and an air-fuel ratio control means that controls a fuel injection quantity to the internal combustion engine so as to bring an air-fuel ratio to the target air-fuel ratio on the basis of the state of fuel of the air-fuel mixture purged from the canister; and a second fuel state determination means that determines the state of fuel of the air-fuel mixture purged from the canister when the purge control valve is closed, wherein the air-fuel ratio control means switches a state of fuel for controlling the fuel injection quantity between the state of fuel determined by the first fuel state determination means and the state of fuel determined by the second fuel state determination means on the basis of an operating state of a vehicle.

2. The fuel vapor treatment apparatus according to claim 1, wherein when the vehicle is in an operating state in which it is before a purge is started, the air-fuel ratio control means determines a fuel injection quantity when the purge is started based on the state of fuel determined by the second fuel state determination means.

3. The fuel vapor treatment apparatus according to claim 1, wherein when the vehicle is in an operating state in which a purge is started and is continued, the air-fuel ratio control means controls the fuel injection quantity based on the state of fuel determined by the first fuel state determination means.

4. The fuel vapor treatment apparatus according to claim 1, wherein when the vehicle is in an operating state in which a purge is interrupted, the air-fuel ratio control means determines a fuel injection quantity when purge is started again based on the state of fuel determined by the second fuel state determination means.

5. The fuel vapor treatment apparatus according to claim 4, wherein when the vehicle is in an operating state in which the purge is interrupted, and when a determination of a state of fuel by the second fuel concentration determination means is uncompleted, the air-fuel ratio control means determines the fuel injection quantity when purge is started again based on a fuel state concentration determined by the first fuel state determination means immediately before the purge is interrupted.

6. The fuel vapor treatment apparatus according to claim 1, further comprising:

a measurement passage that has a restrictor;

a gas flow producing means that produces a gas flow passing through the restrictor;

a pressure measurement means that measures a drop in pressure caused by the restrictor when the gas flow producing means produces the gas flow; and a measurement passage switching means that switches the measurement passage between a first state of measurement in which the measurement passage is opened to the atmosphere and in which gas flowing through the measurement passage is air and a second state of measurement in which the measurement passage is made to communicate with the canister to change gas flowing through the measurement passage to an air-fuel mixture containing the fuel vapor from the canister, wherein the second fuel state determination means determines the state of fuel on the basis of a first pressure measured by the pressure measurement means in the first state of measurement and a second pressure measured by the pressure measurement means in the second state of measurement.

7. The fuel vapor treatment apparatus according to claim 1, wherein the first fuel state determination means determines a relative state of fuel vapor of an air-fuel mixture with respect to the target air-fuel ratio, and further comprising:

a state conversion means that converts the state of fuel determined by the second fuel state means determination means to a relative state of fuel vapor of an air-fuel mixture with respect to the target air-fuel ratio, wherein the air-fuel ratio control means uses a state of fuel after conversion by the state conversion means as the state of fuel determined by the second fuel state determination means.

8. A fuel vapor treatment apparatus for an internal combustion engine, comprising:

a canister that temporarily adsorbs fuel vapor developed in a fuel tank;

a purge pipe that introduces the fuel vapor purged from the canister into an intake pipe of the internal combustion engine;

a purge control valve that is arranged in the purge pipe and controls a purge flow rate from the purge pipe to the intake pipe;

an air-fuel ratio sensor that is provided in an exhaust pipe of the internal combustion engine and measures an air-fuel ratio;

a first fuel state determination means that determines a state of fuel of an air-fuel mixture containing the fuel vapor purged from the canister on the basis of an amount of deviation from a target air-fuel ratio of an air-fuel ratio detected by the air-fuel ratio sensor when the purge control valve is opened; and air-fuel ratio control means that controls a fuel injection quantity to the internal combustion engine to bring an air-fuel ratio to the target air-fuel ratio on the basis of the state of fuel of the air-fuel mixture purged from the canister;

a second fuel state determination means that determines the state of fuel of the air-fuel mixture by purging the air-fuel mixture containing the fuel vapor from the canister in a state in which the purge control valve is closed; and an abnormality detection means that detects an abnormality in the second fuel state determination means, wherein when no abnormality is detected by the abnormality detection means, the air-fuel ratio control means switches a state of fuel for controlling the fuel injection quantity between the state of fuel determined by the first fuel state determination means and the state of fuel determined by the second fuel state determination means on the basis of an operating state of a vehicle, and when an abnormality is detected by the abnormality detection means, the air-fuel ratio control means uses the state of fuel determined by the first fuel state determination means as the state of fuel for controlling the fuel injection quantity irrespective of the operating state of the vehicle.

9. The fuel vapor treatment apparatus according to claim 8, wherein the second fuel state determination means includes:

a measurement passage that has a restrictor;

a pump that produces a gas flow passing through the restrictor;

a pressure measurement means that measures a drop in pressure caused by the restrictor when the pump produces the gas flow; and a measurement passage switching means that switches the measurement passage between a first state of measurement in which the measurement passage is opened to the atmosphere and in which gas flowing through the measurement passage is air and a second state of measurement in which the measurement passage is made to communicate with the canister in a state in which the purge control valve is closed to change gas flowing through the measurement passage to an air-fuel mixture containing the fuel vapor from the canister, the second fuel state determination means determines the state of fuel on the basis of a first pressure measured by the pressure measurement means in the first state of measurement and a second state of measurement measured by the pressure measurement means in the second state of measurement, and the abnormality detection means detects an abnormality in at least one of the measurement passage, the pump, the pressure measurement means, and the measurement passage switching means.

10. The fuel vapor treatment apparatus according to claim 9, further comprising:

a closed space forming valve that brings at least a part of a fuel state detection system including the measurement passage, the pump, the pressure measurement means, and the measurement passage switching means to a closed space;

a leak inspection passage that has one end opened to the atmosphere and has a base restrictor arranged;

a pressurizing means that pressurizes or depressurizes the closed space and the leak inspection passage;

a pressure measurement means that measures pressure in the closed space and the leak inspection passage which are pressurized or depressurized by the pressure application means; and a pressurizing region switching means that switches a pressurized region pressurized or depressurized by the pressurizing means so as to include at least one of the closed space and the leak inspection passage and to switch between two kinds of states of leak measurement that are different from each other in the pressurizing region, wherein the abnormality detection means detects an abnormality in the fuel state detection system on the basis of comparison of two pressures measured by the pressure measurement means in the two kinds of states of leak measurement.

11. The fuel vapor treatment apparatus according to claim 10, wherein the leak inspection passage is the measurement passage.

12. The fuel vapor treatment apparatus according to claim 11, wherein the pressurizing region switching means is the measurement passage switching means.

13. The fuel vapor treatment apparatus according to claim 10, wherein the pressurizing means is a pump that produces a gas flow in the measurement passage.

14. The fuel vapor treatment apparatus according to claim 8, wherein when an abnormality is not detected by the abnormality detection means and the vehicle is in an operating state before starting purge, the air-fuel ratio control means uses the state of fuel determined by the second fuel state determination means.

15. The fuel vapor treatment apparatus according to claim 8, wherein when the vehicle is in an operating state in which a purge is started and is continued, the air-fuel ratio control means uses the state of fuel determined by the first fuel state determination means.

16. The fuel vapor treatment apparatus according to claim 8, wherein when no abnormality is detected by the abnormality detection means and the vehicle is in an operating state in which purge is interrupted, the air-fuel ratio control means uses the state of fuel determined by the second fuel state determination means.

17. The fuel vapor treatment apparatus of an internal combustion engine according to claim 16, wherein when the vehicle is in an operating state in which purge is interrupted, and when a determination of the state of fuel by the second fuel concentration determination means is uncompleted, the air-fuel ratio control means uses the state of fuel determined by the first fuel state determination means immediately before purge is interrupted.

18. A fuel vapor treatment apparatus for an internal combustion engine, comprising:

a canister that temporarily adsorbs fuel vapor developed in a fuel tank;

a purge pipe that introduces the fuel vapor purged from the canister into an intake pipe of the internal combustion engine;

a purge control valve that is arranged in the purge pipe and controls a purge flow rate from the purge pipe to the intake pipe;

an air-fuel ratio sensor that is provided in an exhaust pipe of the internal combustion engine and measures an air-fuel ratio;

a first fuel state determiner that determines a state of fuel of an air-fuel mixture containing the fuel vapor purged from the canister on the basis of an amount of deviation from a target air-fuel ratio of an air-fuel ratio detected by the air-fuel ratio sensor when the purge control valve is opened; and an air-fuel ratio controller that controls a fuel injection quantity to the internal combustion engine so as to bring an air-fuel ratio to the target air-fuel ratio on the basis of the state of fuel of the air-fuel mixture purged from the canister; and a second fuel state determiner that determines the state of fuel of the air-fuel mixture purged from the canister when the purge control valve is closed, wherein the air-fuel ratio controller switches a state of fuel for controlling the fuel injection quantity between the state of fuel determined by the first fuel state determination means and the state of fuel determined by the second fuel state determination means on the basis of an operating state of a vehicle.

19. A fuel vapor treatment apparatus for an internal combustion engine, comprising:

a canister that temporarily adsorbs fuel vapor developed in a fuel tank;

a purge pipe that introduces the fuel vapor purged from the canister into an intake pipe of the internal combustion engine;

a purge control valve that is arranged in the purge pipe and controls a purge flow rate from the purge pipe to the intake pipe;

an air-fuel ratio sensor that is provided in an exhaust pipe of the internal combustion engine and measures an air-fuel ratio;

a first fuel state determiner that determines a state of fuel of an air-fuel mixture containing the fuel vapor purged from the canister on the basis of an amount of deviation from a target air-fuel ratio of an air-fuel ratio detected by the air-fuel ratio sensor when the purge control valve is opened; and air-fuel ratio controller that controls a fuel injection quantity to the internal combustion engine to bring an air-fuel ratio to the target air-fuel ratio on the basis of the state of fuel of the air-fuel mixture purged from the canister;

a second fuel state determiner that determines the state of fuel of the air-fuel mixture by purging the air-fuel mixture containing the fuel vapor from the canister in a state in which the purge control valve is closed; and an abnormality detector that detects an abnormality in the second fuel state determination means, wherein when no abnormality is detected by the abnormality detector, the air-fuel ratio controller switches a state of fuel for controlling the fuel injection quantity between the state of fuel determined by the first fuel state determiner and the state of fuel determined by the second fuel state determiner on the basis of an operating state of a vehicle, and when an abnormality is detected by the abnormality detector, the air-fuel ratio controller uses the state of fuel determined by the first fuel state determiner as the state of fuel for controlling the fuel injection quantity irrespective of the operating state of the vehicle.

* * * * *